US010954775B2

(12) United States Patent
Islam et al.

(10) Patent No.: US 10,954,775 B2
(45) Date of Patent: Mar. 23, 2021

(54) METHOD AND APPARATUS FOR AUTOMATED PRESSURE INTEGRITY TESTING (APIT)

(71) Applicant: EQUINOR ENERGY AS, Stavanger (NO)

(72) Inventors: Md Aminul Islam, Stavanger (NO); Ole Anders Helstrup, Stavanger (NO); Hans Joakim Skadsem, Stavanger (NO); Sonja Moi, Sola (NO); Liv Almas Carlsen, Stavanger (NO)

(73) Assignee: EQUINOR ENERGY AS, Stavanger (NO)

( * ) Notice: Subject to any disclaimer, the term of this patent is extended or adjusted under 35 U.S.C. 154(b) by 313 days.

(21) Appl. No.: 16/070,670

(22) PCT Filed: Jan. 18, 2017

(86) PCT No.: PCT/NO2017/050015
§ 371 (c)(1),
(2) Date: Jul. 17, 2018

(87) PCT Pub. No.: WO2017/126974
PCT Pub. Date: Jul. 27, 2017

(65) Prior Publication Data

US 2019/0292901 A1 Sep. 26, 2019

(30) Foreign Application Priority Data

Jan. 18, 2016 (GB) ..... 1600897

(51) Int. Cl.
*E21B 47/06* (2012.01)
*E21B 49/00* (2006.01)
*E21B 47/117* (2012.01)

(52) U.S. Cl.
CPC ..... *E21B 47/06* (2013.01); *E21B 47/117* (2020.05); *E21B 49/008* (2013.01)

(58) Field of Classification Search
CPC ..... E21B 47/06; E21B 47/003; E21B 47/005; E21B 47/007–008; E21B 47/10;
(Continued)

(56) References Cited

U.S. PATENT DOCUMENTS

2009/0101340 A1 4/2009 Jeffryes
2011/0024195 A1 2/2011 Hoyer et al.
(Continued)

FOREIGN PATENT DOCUMENTS

GB 2 347 447 9/2000

OTHER PUBLICATIONS

Alberty et al., The Use of Modeling To Enhance the Analysis of Formation-Pressure Integrity Test, Dec. 2014 SPE Drilling & Completion, pp. 431-437 (Year: 2014).*
(Continued)

*Primary Examiner* — Toan M Le
(74) *Attorney, Agent, or Firm* — Wenderoth, Lind & Ponack, L.L.P.

(57) ABSTRACT

A method of conducting a pressure integrity test for an underground formation includes: whilst fluid is supplied to and/or released and returned from the underground formation under pressure, using an automated monitoring and supervisory system to: monitor the pressure of the fluid being supplied to and/or returned from the underground formation in real-time, monitor a volume of the fluid that is supplied to and/or returned from the underground formation in real-time, determine one or more relationship(s) for the monitored pressure and the monitored volume as the pressure and the volume vary relative to each other and/or with time during the real-time monitoring thereof, and analyze
(Continued)

the monitored pressure and volume data using the one or more relationship(s) either in real-time or after completion of the pressure integrity test in order to provide information and/or warnings concerning at least one parameter relating to the underground formation.

27 Claims, 8 Drawing Sheets

(58) Field of Classification Search
CPC ..... E21B 47/117; E21B 49/00; E21B 49/005–006; E21B 49/008; E21B 49/087
See application file for complete search history.

(56) References Cited

U.S. PATENT DOCUMENTS

| | | | |
|---|---|---|---|
| 2012/0059521 | A1 | 3/2012 | Iversen et al. |
| 2013/0186688 | A1 | 7/2013 | Rasmus et al. |
| 2014/0058686 | A1 | 2/2014 | Anderson et al. |

OTHER PUBLICATIONS

International Search Report and Written Opinion of the International Searching Authority dated Jun. 4, 2017 in International (PCT) Application No. PCT/NO2017/050015.

Great Britain Search Report dated Aug. 25, 2016 in corresponding UK Application No. GB1600897.1.

Islam, M. A. et al., "A New Supervisory System for Improved Formation Integrity Testing". ResearchGate [online] Jul. 28, 2015. [retrieved on Mar. 24, 2017]. Retrieved from <https://www.researchgate.net/publication/280527887_A_New_Supervisory_System_for_Improved_Formation_Integrity_Testing>. Whole document.

Raaen, A. M. et al., "Stress Determination From Hydraulic Fracturing Tests: The System Stiffness Approach". International Journal of Rock Mechanics and Mining Sciences, 2001, vol. 38, No. 4, pp. 529-541, Abstract, Sections 2.3, 2.4, 3.1, 5.1, 5.2 and Figs. 2, 7.

Raaen, A. M. et al. "Improved Routine Estimation of the Minimum Horizontal Stress Component from Extended Leak-Off Test". International Journal of Rock Mechanics and Mining Sciences, 2006, vol. 43, No. 1, pp. 37-48. Whole document.

Altun, G. et al., "Application of a New Model to Analyze Leakoff Tests". Society of Petroleum Engineers (SPE) Annual Technical Conference and Exhibition, Oct. 3-6, 1999, Houston, Texas. SPE-56761-MS.Whole document.

Postler, D.P., "Pressure Integrity Test Interpretation". SPE/IADC Drilling Conference, Amsterdam, Netherlands, Mar. 4-6, 1997. SPE-37589-MS. Whole document.

Leoben, "Investigation of the "Plastic-Behaviour" Region in Leak-Off Tests", published Aug. 11, 2011, Available from http://www.unileoben.ac.at/images/stories/Bibliothek/edoc/AC08882729n01vt.pdf, (Allerstorfer), pp. 1-20.

* cited by examiner

METHOD AND APPARATUS FOR AUTOMATED PRESSURE INTEGRITY TESTING (APIT)

BACKGROUND OF THE INVENTION

1. Field of the Invention

The present invention relates to a method and an apparatus for conducting a pressure integrity test for an underground formation, such as a Formation Integrity Test (FIT), Leak Off Test (LOT) or Extended Leak Off Test (XLOT), for example.

2. Description of the Related Art

After drilling out cement at the start of a new wellbore section, a formation integrity test is routinely performed to verify the integrity of the new formation and the cement at the casing shoe. These test results largely impact the drilling operation, such as motivating remedial cementing operations, changing the drilling fluid mass density or setting depth of the casing strings. Interpretation of the test results are often challenging for a number of reasons, including significant fluid losses to permeable formations, large friction pressure losses, compression of trapped air and unstable pump operation.

Formation Integrity Tests (FITs), Leak-off Tests (LOTs) and Extended Leak-off Tests (XLOTs) along with other standard pressure integrity tests such as casing tests and valve tests, are common procedures during various well operations. Current methods for performing pressure integrity tests involve manual procedures for operating the pumps and chokes as well as manual interpretation and reporting of the test results.

SUMMARY OF THE INVENTION

Viewed from a broad aspect, that is not currently claimed, the invention provides a method of conducting a pressure integrity test for an underground formation whilst fluid is supplied to and/or released and returned from the underground formation under pressure, the method comprising:

using an automated monitoring and supervisory system to monitor the pressure of the fluid that is being supplied to and/or returned from the underground formation in real-time, using the automated monitoring and supervisory system to monitor the volume of fluid that is being supplied to and/or returned from the underground formation in real-time, using the automated monitoring and supervisory system to determine one or more relationship(s) for the monitored pressure and for the monitored volume as the pressure and the volume vary relative to each other and/or with time during the real-time monitoring thereof, and using the automated monitoring and supervisory system to analyze the monitored pressure and volume data using the relationship(s) either in real-time or after completion of the pressure integrity test in order to provide information and/or warnings concerning one or more of: parameters relating to the underground formation, the performance of the test during testing, the outcome of the test, the quality of the monitored data, or test metrics such as leakage rate, trapped air, unstable pump rate, plugged choke, system compliance, surface pressure and surface volume.

This method forms the basis for a new automated supervisory system providing real-time test analysis and automated result interpretation from pressure integrity tests such as formation integrity tests, leak-off tests and extended leak-off tests. This goes beyond mere automation of the prior art manual techniques, since it allows for reaction to real-time trends and real-time feedback on the tests in a manner than is impossible with manual monitoring.

The high dependency on manual processes in the prior art gives rise to poor consistency and repeatability for the pressure tests. The proposed automated method will provide the ability to have a standardized and sustainable robust workflow system to meet the challenges of data logging, data storage and test reporting, which are highly important to the oil and gas industry. The method has a requirement for both pressure and also volume measurement of the fluid that is being supplied to the underground formation, i.e. the use of both pressure and volume sensors at an above-ground location, along with real-time monitoring of both the pressure and the volume of fluid as it is supplied to and/or returned from the formation. Advantageously, the system can cover all test phases, from pressurization, fracture propagation to shut-in and flow-back, with a minimum of user input. The assessment of test performance and quality is made more reliable and consistent, and the real-time monitoring and analysis allows for reaction to real-time shifts in monitored data in a way that is not possible with current monitoring techniques for pressure integrity tests, which are done manually and/or after completion of the test(s).

In one aspect, the invention provides a method of conducting a pressure integrity test for an underground formation whilst fluid is supplied to and/or released and returned from the underground formation under pressure, the method comprising:

using an automated monitoring and supervisory system to monitor the pressure of the fluid that is being supplied to and/or returned from the underground formation in real-time, using the automated monitoring and supervisory system to monitor the volume of fluid that is being supplied to and/or returned from the underground formation in real-time, using the automated monitoring and supervisory system to determine one or more relationship(s) for the monitored pressure and for the monitored volume in real-time as the pressure and the volume vary relative to each other and with time during the real-time monitoring thereof, and using the automated monitoring and supervisory system to analyze the monitored pressure and volume data using the relationship(s) in real-time in order to provide information and/or warnings in real-time during the pressure integrity test, wherein the information and/or warnings concern one or more of: parameters relating to the underground formation, the performance of the test during testing, the outcome of the test, the quality of the monitored data, or test metrics such as leakage rate, trapped air, unstable pump rate, plugged choke, system compliance, surface pressure and surface volume.

In this aspect the automated monitoring and supervisory system gathers data in real-time and then analyses it in real-time. As discussed in more detail below this allows for significant advantages in terms of identifying and addressing issues that arise during the test. It is possible to operate the test more efficiently and to determine the outcome of the test more efficiently and more quickly with this method compared to prior art techniques.

The volume sensor is a sensor arranged to measure the volume of fluid entering and/or leaving the underground formation. There may be separate volume sensors for measuring the volume of fluid being supplied to the underground formation and for measuring the volume of fluid being returned from the underground formation, or alternatively the same sensor may be used in each case. The volume sensor(s) should be located topside. It is preferred for the sensor to allow for measurements in steps of 10 liters or less, or 5 liters or less, preferably 2 liters or less, with an accuracy of ±5%.

Preferably the volume sensor is able to operate at a sampling rate of 5 seconds or less, for example there may be a sampling rate of 2 seconds or below, or 1 second or below. The data sampling interval may hence be about 1 seconds or about 2 seconds. It is possible to process data with a higher sampling interval (e.g. 5 seconds), but the analysis results are less accurate, and it is more likely that the test interpretation is inconclusive.

The use of a suitably accurate and high resolution volume sensor in the context of the broad aspect set out above is considered novel and inventive in its own right. Thus in another aspect the invention provides a method of conducting a pressure integrity test for an underground formation whilst fluid is supplied to and/or released and returned from the underground formation under pressure, the method comprising:

using an automated monitoring and supervisory system to monitor the pressure of the fluid that is being supplied to and/or returned from the underground formation in real-time, using the automated monitoring and supervisory system to monitor the volume of fluid that is being supplied to and/or returned from the underground formation in real-time with a volume sensor capable of measuring volume of the fluid in steps of 10 liters or less and with a sampling rate of 5 seconds or below, using the automated monitoring and supervisory system to determine one or more relationship(s) for the monitored pressure and for the monitored volume as the pressure and the volume vary relative to each other and/or with time during the real-time monitoring thereof, and using the automated monitoring and supervisory system to analyze the monitored pressure and volume data using the relationship (s) either in real-time or after completion of the pressure integrity test in order to provide information and/or warnings concerning one or more of: parameters relating to the underground formation, the performance of the test during testing, the outcome of the test, the quality of the monitored data, or test metrics such as leakage rate, trapped air, unstable pump rate, plugged choke, system compliance, surface pressure and surface volume.

This aspect concerns the use of volume measurements at a required minimum standard, with these measurements being obtained by the automated monitoring and supervisory system, which then determines relationships for the monitored pressure and for the monitored volume as the pressure and the volume vary relative to each other and/or with time, and also analyses the data, for example via the determined relationships, in order to provide information and/or warnings about the pressure integrity test. By requiring a minimum standard for the volume measurements and through the use of an automated data recording and analysis system then this aspect can provide capabilities not possible with prior art methods, as discussed in more detail below. It should be noted that the volume measurements may be in smaller volume steps and/or at a higher resolution (smaller sampling time) as set out above. The discussion below applies to any of the aspects set forth above.

The volume sensor may be an ultrasound sensor or a floating ball sensor, for example for measurement of the volume within a displacement tank. The method may also make use of a flow meter as the volume sensor.

The system may include a flow-back choke, pump and/or shut in valve. The choke and valve should preferably be installed in the return flow line (FIG. 1). The use of a flow-back choke may advantageously include using a choke that can be set with a fixed valve opening, i.e. as distinct from a choke that can only operate with a pressure controlled opening. A flow-back choke, preferably one that can be set with a fixed valve opening, may be used to maintain a lower pressure during flow-back and hence enable use of a lower pressure rated volume sensor and/or pressure sensor. In some example embodiments a combination of two valves is used, where one valve can be either fully open or fully closed, and the other valve is pre-set with a fixed opening. The use of a flow meter and choke or valve arrangement can provide an improved monitoring of volume compared to prior art techniques, such as calculating volume based on the pump strokes and/or pump speed, or using level sensors in fluid reservoirs, for example in fluid displacement tanks.

One possible choke arrangement in the return line to the displacement tanks is two valves in series: The first valve is either fully open or fully closed, while the second valve is set at a predetermined choke opening. Flowback will start when the first valve is opened. Fluid is then produced back through the fully opened first valve, and then through the choke set at a predetermined opening and into the displacement tanks. According to the system stiffness interpretation of XLOTs, however, flowing back over a choke with a fixed opening is preferred.

Most conventional cement units include a pressure-controlled choke that maintains a constant flowback rate. Consequently, a hardware modification/replacement is required in order to achieve flowback over a constant choke opening. The hardware modification can be permanent, since other operations with the cement unit are not sensitive to the type of choke installed on the return line. The two new valves may be operable from the cement unit control system and its graphical user interface; i.e. the state of the first valve (fully open or fully closed) and the desired choke opening of the second valve may be configurable from the control system.

The preferred embodiments thus require a volume sensor of greater accuracy and improved sampling rate compared to volume sensors that are typically present in existing installations. The method may include installing an upgraded sensor to the installation to thereby enable automated monitoring and analysis as proposed herein.

The pressure sensor should be located top-side at a point where the pressure is equivalent to, or has a known relationship to, the pressure at the point of entry of the fluid into the underground formation (or equivalently, at the point of exit of the fluid from the underground formation). Thus, the pressure sensor should generally be after the pump and before the wellhead. There may be multiple pressure sensors at various points in the system: this can provide confirmation of the pressure reading and ensure that faulty sensors are easily identified.

The pressure sensor may have a pressure rating of 15000 psi (103 MPa) with accuracy of ±2%, i.e. about 300 psi or 2 MPa, but preferably a higher resolution sensor is used, i.e. with greater resolution than commonly installed pressure gauges. Thus, the pressure sensor may have a resolution of 0.5 MPa or lower. Alternatively or additionally the method may use a pressure sensor with a lower pressure rating, for example 5000 psi (34.5 MPa) or 2000 psi (13.8 MPa), with this pressure sensor being isolatable or removable to allow for high pressure use of the system during normal use, and measurement of pressure with the lower rated pressure sensors during lower pressure formation integrity tests in order to provide higher accuracy pressure measurements. The pressure sensor may be isolated by means of valves and a parallel pipe. Alternatively it may be a temporary device that is installed only during a formation integrity test.

Preferably the pressure sensor is able to operate at a sampling rate of 5 seconds or less, for example there may be a sampling rate of 2 seconds or below, or 1 second or below.

The method may optionally include plotting the monitored pressure and volume and/or the relationship between pressure and volume and preferably also displaying the plot to the user in real-time. This provides the user with real-time information on the raw data, which can be enhanced with further alerts and real-time analysis by the automated system.

The method may be used to determine the fracture closure pressure, and hence the step of analyzing may include using the monitored data to determine the fracture closure pressure based on the monitored pressure and optionally on the measured volume. This may involve using the method after fluid has been supplied to the underground formation under pressure and whilst the fluid pressure is being released and fluid is returned from the formation, with the pressure and volume of the returned fluid being monitored in real-time, and the step of analyzing involving determining the fracture closure pressure. The fracture closure pressure may be determined as the minimum principle stress within the underground formation, which is often designated as $\sigma_{min}$ in the usual nomenclature for fracture mechanics. One technique for determining the fracture closure pressure is to use the monitored data to find the system stiffness for the reaction of the underground formation to the pressure integrity test, and identify a point when a change in stiffness indicates opening or closing of a fracture. The pressure at this point will provide the fracture closure pressure. In this case it is necessary to use both of the monitored pressure and the monitored volume.

The fracture closure pressure may be determined by analysis of a plot of pressure against volume as fluid is supplied to the underground formation. The fracture closure pressure may alternatively or additionally be determined by analysis of a plot of the square root of pressure against time as fluid is supplied to the underground formation. A value for the fracture closure pressure may be determined by finding a change point in the plot of pressure against volume and/or the plot of square root of pressure against time. When the fracture is closed the system stiffness can be approximated to the drilling fluid stiffness, which is related to the compressibility of the drilling fluid. This stiffness is relatively high. When the fracture is open the stiffness is dominated by the fracture stiffness and it is relatively low. It can be assumed that the behavior of the system can be fit to two straight lines in the plots referenced above, with a first line relating to behavior of the system during open fracture, and a second line of differing gradient relating to the behavior of the system with closed fracture. A change point is a point where the system stiffness changes from one mode (representing a close fracture) to another and this can be found by the intersection of the two straight lines that are fit to the plot. The straight lines may be fit to the plots by any suitable technique, for example via linear regression.

By use of the automated and real-time monitoring of pressure and volume it is possible to obtain the data required to determine fracture closure pressure in real-time, and a determination of the fracture closure pressure can be made just as soon as there is sufficient data to fit two straight lines to the plot(s) with a required degree of confidence. Thus, the fracture closure pressure can be found far more quickly than with the prior art, and even in some cases before the pressure integrity tests are completed. The method may include using both of the plot of pressure against volume and/or the plot of square root of pressure against time to find values for the fracture closure pressure, and then comparing the two values. If the two values are the same or similar then this gives a high degree of confidence in the result. If they differ by too much then this may indicate a bad test, or that the underground formation behaves in a more complex way than allowed for by the simple two-stiffness approximation.

Alternatively or additionally the method may include the use of multiple cycles of supplying and releasing fluid to/from the formation, with values for the fracture closure pressure being determined from two or more of the multiple cycles, and the fracture closure pressure values for different cycles being compared. Again, if the different values are the same or similar then this increases the degree of confidence in the determined fracture closure pressure, whereas if they differ by too much then there is a reduced confidence and this may indicate a bad test or that the model does not work for the formation in question.

In one example, the method is used during supplying of fluid to the installation and the step of analyzing involves a real-time step of, during the pressure integrity test and whilst fluid is being supplied to the formation, calculating a forecast that predicts future values of the pressure and the volume for a look-ahead time period and determining if the future values will cross outside of an envelope defining allowable pressure and volume values.

This feature hence provides, in a further aspect of the invention, a method of conducting a pressure integrity test for an underground formation, the method comprising: whilst fluid is supplied to the underground formation under pressure, using an automated monitoring and supervisory system to: monitor the pressure of the fluid being supplied to the underground formation in real-time, monitor the volume of fluid that is supplied to the underground formation in real-time, determine one or more relationship(s) for the monitored pressure and the monitored volume as they vary relative to each other and/or with time during the real-time monitoring thereof, calculate a forecast that predicts future values of the pressure and the volume for a look-ahead time period, and determine if the future values will cross outside of an envelope defining allowable pressure and volume values.

This method makes use of the real-time monitoring to allow a real-time analysis of the pressure integrity test and the ability to forecast future values during the test, hence providing advantages not possible using existing techniques. In prior art methods of the type discussed above volume measurements are generally not available and there is no real-time monitoring without any calculation of a forecast for future values. Instead, the pressure data is monitored manually and decisions are made by the operator as to whether or not the test should be stopped. Hence it is not possible with these methods to make an accurate prediction, in real-time, of a failed test. Instead, the existing manual techniques have inconsistent results due to different approaches from different operators and will often have tests stopped unnecessarily or tests will not be stopped at an early stage when they should have been stopped. The proposed method avoids these problems.

The look-ahead time period may be set based on covering a number of sampling points, for example looking at least 5 sampling points ahead, or optionally a number of sampling points selected from the range of 5-10 sampling points. The look-ahead time period may be more than this, for example 10 sampling points or more. By way of example, when the sampling rate is 1, 2 or 5 seconds, the then the look-ahead time may correspondingly be 5, 10 or 25 seconds in order to cover 5 sampling points.

The step of calculating a forecast preferably uses the relationship(s) determined in connection with the recorded pressure and volume data, and this step may be based on a predetermined sample size for recent sampling points, for example it may cover a time equivalent to at least 5 sampling points, or from 5 to 10 sampling points, or at least 10 sampling points. It is preferred for the step of calculating a forecast to be based on looking back over the recorded data for a time equivalent to the look-ahead time.

The step of forecasting preferably begins just as soon as sufficient data is gathered, for example once 5 or more samples are recorded, and may be repeated until the forecast future values cross outside of the envelope (or until the test is completed).

The relationship(s) between pressure and volume may be determined by fitting a curve or line to the data based on expected curve shapes for the test concerned. This may include fitting a curve or line to all data or to recent data using modelling or regression or other mathematical techniques. The recent data may be a number of samples looking back as discussed above in relation to the look-ahead time. It is important to note that this may not involve using a single formula or type of formula. The behavior of the real-world system may be non-linear, and the relationship(s) may be an approximation.

The envelope defining allowable pressure and volume values may be equivalent to thresholds used conventionally in equivalent formation integrity tests. The invention provides the advantage that the method can indicate in real-time when the forecast values will pass outside the envelope. The envelope may include, in a plot of pressure against volume, a lower threshold set as the base-line compressibility for the underground formation, with an upper threshold set as a multiple of the base-line compressibility. The multiple is a safety factor determined in accordance with usual practice. The base-line compressibility may be determined as a part of the method or in earlier testing or based on historical values. This may be done by testing compressibility of the fluid and casing after the cement is in place but prior to exposing formation (the next section in drilling). In addition, horizontal curves corresponding to maximum allowable test pressure and minimum expected leak-off pressure can be drawn.

The thresholds that are used rely on an accurate estimation of the anticipated leak-off pressure for determining the maximum volume line. Due to the difficulty of assessing the anticipated leak-off pressure, a simpler approach based on minimum and maximum volume lines is often preferable and may be used with the current method: in a possible simpler approach, the minimum volume line is the pressure build-up associated with compression of drilling fluid:

$$\Delta V = cV_0\Delta p = C_{min}\Delta p,$$

where $\Delta p = p_n - p_1$, $\Delta V = V_n - V_1$, $p_n$ is the n-th pressure measurement, $V_n$ is the n-th volume measurement, $p_1$ and $V_1$ are reference pressure and volume, $V_0$ is the system volume, and c is the system compliance from a casing integrity test. The maximum volume is drawn with the line:

$$\Delta V = C_{max}\Delta p.$$

In an example embodiment, the default value for $C_{max}$ is $C_{max} = 4cV_0$ for OBM and $C_{max} = 2.5\ cV_0$ for WBM/SBM, where c is the system compliance from a casing integrity test. The maximum and minimum volume lines require information about the system volume for the formation integrity test, $V_0$, and the system compliance, c, from a casing integrity test.

In one example, the method is used after fluid has been supplied to the underground formation under pressure and whilst the fluid pressure is being released and fluid is returned from the formation, the pressure and volume of the returned fluid is monitored in real-time, and the step of analyzing involves determining expected pressure values based on a hydrostatic approximation of the pressure inside the wellbore and comparing the real-time monitored values to the expected values of the underground formation. This may be in addition to the analyzing steps discussed above, or it may be done without the use of the other analysis steps.

This feature hence provides, in a further aspect of the invention, a method of conducting a pressure integrity test for an underground formation, the method comprising: after fluid has been supplied to the underground formation under pressure and whilst the fluid pressure is being released and fluid is returned from the formation, using an automated monitoring and supervisory system to: monitor the pressure of the fluid in real-time as it is returned from the underground formation, monitor the volume of fluid that is returned from the underground formation in real-time, determine one or more relationship(s) for the monitored pressure and the monitored volume as they vary relative to each other and/or with time during the real-time monitoring thereof, determine expected pressure values based on a hydrostatic approximation of the pressure inside the wellbore and compare the real-time monitored values to the expected values of the underground formation.

Thus, with these features the method is used to compare surface readings to a downhole prediction in the form of the expected values. This can be used to identify discrepancies in either the test itself, or in the expected values and/or in modelling used to determine the expected values. If the comparison finds a close match, then this validates both the test and the expected values. If the comparison finds a discrepancy then this can be notified to the user and either the user or preferably the automated system can propose further steps to identify the reasons for the discrepancy and/or propose a resolution.

The method may include the provision of alerts if the monitored values deviate from expected values by more than a threshold amount/tolerance limit. There may be an alert if the system is unable to fit a curve to the monitored data, i.e. the system is not able to do an interpretation. In this event the test may be continued, or it may automatically be stopped.

The method may include identifying a stable shut-in pressure by determining when the monitored pressure and expected pressure cease to vary with time during shut-in. In addition, the stable shut-in pressure in different cycles of testing can be compared to check that a repeatable result has been obtained. Advantageously these steps can be done automatically and in real-time with the proposed method.

The method may include carrying out a cycle of pressure increase and release after a stable shut-in pressure (for example, for an XLOT), repeating the cycle, and making a real-time assessment of whether or not the second cycle is similar to the first cycle. For example, the fracture closure pressures for the first and second cycle might be compared as discussed above.

In one example, the step of analyzing involves a real-time step of, during the pressure integrity test and whilst fluid is being supplied to the formation, gathering information relating to the quality of the data available for monitoring the pressure and/or the volume, assessing that information including determining the potential quality of the interpretation of the data, and providing an indication of the quality of the pressure integrity test results based on the information.

This feature hence provides, in a further aspect of the invention, a method of conducting a pressure integrity test for an underground formation, the method comprising: whilst fluid is supplied to the underground formation under pressure, using an automated monitoring and supervisory system to: monitor the pressure of the fluid being supplied to the underground formation in real-time, monitor the volume of fluid that is supplied to the underground formation in real-time, gather information relating to the quality of the data available for monitoring the pressure and/or the volume, assess that information including determining the potential quality of the interpretation of the data, and provide an indication of the quality of the pressure integrity test results based on the information.

The information relating to the quality of the data may include one or more of sampling intervals, availability of volumetric flowback data, whether the data is digital or analogue, the linearity of the pump-in compliance, the magnitude of the pump-in compliance, the number of pump-in cycles and so on.

The method may check parameters relating to the quality of the data and rank the quality of the test and the quality of interpretation. The ranking may be a score in a pre-set range, for example from 1 to 5, with one being worthless and 5 being excellent. Other ranges may of course be used.

By way of example, factors that might result in the lowest ranking (e.g. 1, for a score of 1 to 5) may include one or more of unusable data (e.g. data that cannot be fitted with a curve or line) non-linear pump in compliance and/or fracture closure pressure values determined based on top side measurements having greater than 0.1 SG between maximum and minimum values.

If all the factors required for the lowest score are present then factors that might result in a higher, yet still poor ranking (e.g. 2, for a score of from 1 to 5) could include one or more of: the sampling rate for topside data being too high, for example a sampling rate of over 5 seconds, the pump in compliance being excessively high, for example more than twice the expected value and/or fracture closure pressure values determined based on downhole measurements having greater than 0.1 SG between maximum and minimum values.

If all the factors required for the lower scores are present then factors that might result in a higher ranking, perhaps a ranking denoted average (e.g. 3, for a score of from 1 to 5) could include one or more of: an absence of downhole data, the sampling rate for downhole data being too high, for example a sampling rate of over 5 seconds, an absence of volumetric flow-back data, pump in compliance being more than 1.5 times the expected value, a failure to have a minimum number of pump in cycles (for example at least two pump in cycles), fracture closure pressure values having greater than 0.05 SG difference, total flowback volume being less than 50% and/or the closed fracture compliance being in excess of twice the expected fracture compliance.

If all the factors required for the lower scores are present then factors that might result in a higher ranking, perhaps a ranking denoted good (e.g. 4, for a score of from 1 to 5) could include one or more of: topside data sampling rate exceeding 1 second, downhole sampling rate exceeding 2 seconds, volumetric flowback sampling rate being above two seconds, pump in compliance being more than 1.25 times the expected value, closed fracture compliance being more than 1.75 times the expected value, total flowback volume being less than 70%, and a failure for all fracture closure pressure interpretations to be within 0.02 SG.

If all the factors required from those set forth above are passed then the ranking would be the highest available, for example a ranking denoted excellent, or a score of 5 on a scale of 1 to 5.

It will be appreciated that alternative quality test criteria could be set, and the ranking system may use alternative scoring as well as finer graded scoring, for example splitting each banding in the 1-5 score into two to provide a 1-10 score. The operator may set a minimum ranking for a test to be allowed to continue, so that if any criteria is failed indicating, for example, a ranking of average or below and the test is stopped and repeated with improvements made to increase the quality of the test. The operator may allow tests to continue despite a low ranking, but then assign less importance or lesser certainty to the results of those tests, and perhaps allocate resources to repeating those tests of the lowest quality from a given sequence or series of testing.

The system may make recommendations to the user automatically, for example to repeat the test/cycle (optionally with certain settings adjusted), to have a different test, to perform maintenance of sensors and so on. The recommendations for adjustment of settings may include changes to the sampling rate changes to the choke settings (flow back time) and/or to the sampling time.

The method may be utilized for any known formation integrity tests, for example FIT, LOT, XLOT and so on. The method may include a combination of tests with analysis based on all test, including comparing parameters derived from different tests. The underground formation may be any formation accessed via a wellbore, but in particular it is a formation accessed by a wellbore in the oil and gas industry.

The invention extends to a computer program product for any or all of the method(s) described above.

Thus, a further aspect provides a computer program product comprising instructions that, when executed, will configure a data processing apparatus to operate an automated monitoring and supervisory system whilst fluid is supplied to and/or released and returned from an underground formation under pressure, the automated monitoring and supervisory system being operated to:

monitor the pressure of the fluid being supplied to and/or returned from the underground formation in real-time, monitor the volume of fluid that is supplied to and/or returned from the underground formation in real-time, determine one or more relationship(s) for the monitored pressure and the monitored volume as they vary relative to each other and/or with time during the real-time monitoring thereof, and analyze the monitored pressure and volume data using the relationship(s) either in real-time or after completion of the pressure integrity test in order to provide information and/or warnings concerning one or more of: parameters relating to the underground formation, the performance of the test during testing, the outcome of the test, the quality of the monitored data, or test metrics such as leakage rate, air trap, plugged choke, system compliance surface pressure and surface volume.

The computer program product may further operate the automated monitoring and supervisory system in accordance with any or all of the other method features discussed above and/or in accordance with any aspect set out above. The automated monitoring and supervisory system may include sensors as discussed above, and/or it may be arranged to receive data from such sensors.

The invention also extends to an automated monitoring and supervisory system arranged to operate in accordance with any or all of the method(s) discussed above, as well as to an oil and gas installation comprising the automated monitoring and supervisory system.

The system may include at least one pressure sensor and at least one volume sensor for the real-time monitoring of pressure and volume. The sensor(s) may be as discussed above. The system may include other components as discussed above.

BRIEF DESCRIPTION OF THE DRAWINGS

Certain preferred embodiments of the invention will be described below by way of example only and with reference to the accompanying drawings in which.

DETAILED DESCRIPTION OF THE INVENTION

Figure 1:
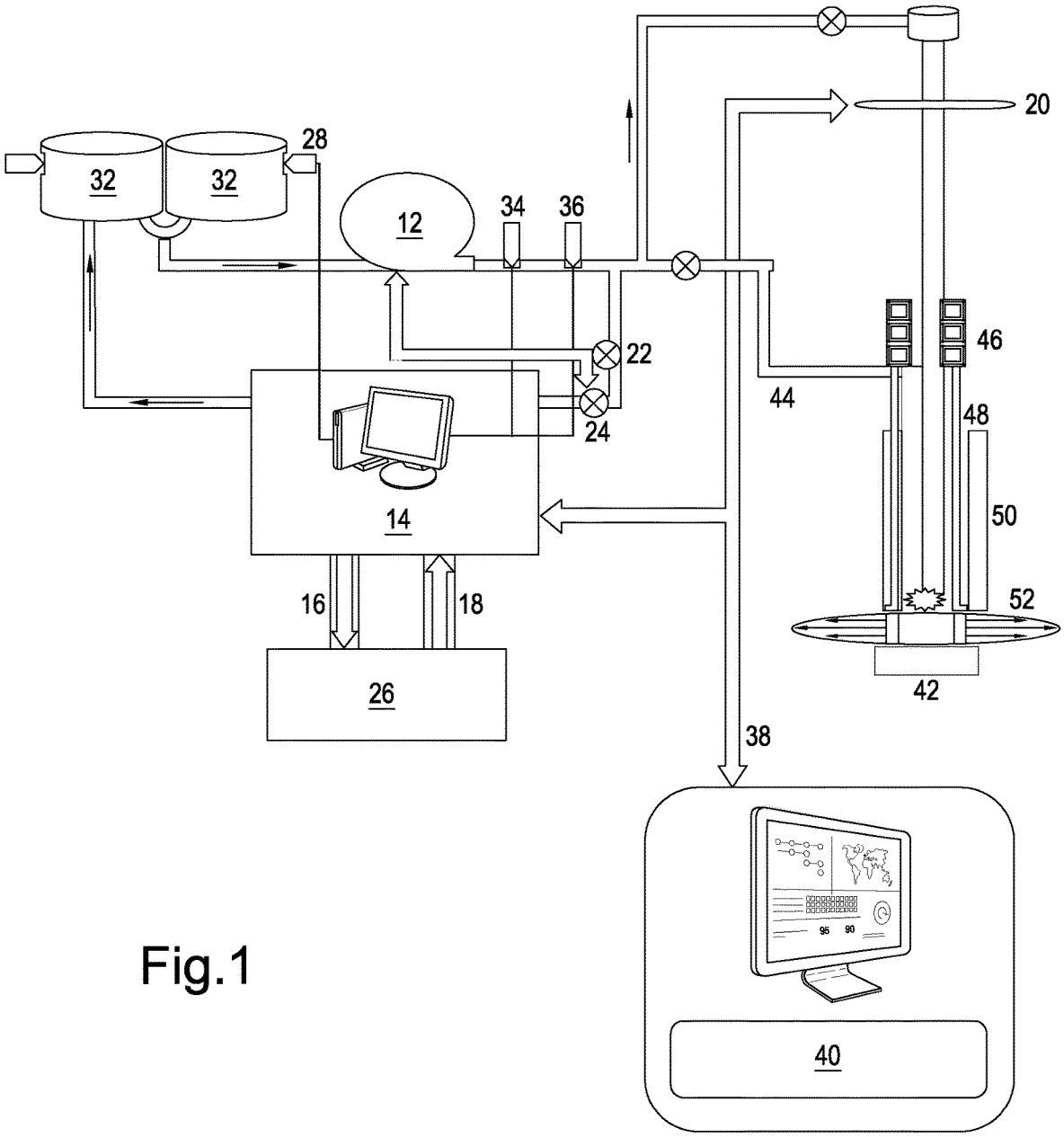
FIG. 1 shows a physical overview of an automated pressure integrity testing system.

The example embodiment is a new supervisory system providing real-time test analysis and automated result interpretation from pressure integrity tests, leak-off tests and extended leak-off tests. The system provides Automated Pressure Integrity Tests (APIT) as distinct from the manual tests used in the prior art. Based on a minimum of preconfigured user input, the system covers all test phases, from pressurization, fracture propagation to shut-in and flowback. Rather than relying on computationally intensive modelling of downhole physics, we apply regression techniques to relate surface pressure to injected fluid volume, shut-in duration and volume or time in flowback.

In summary, system compliance and fluid leakage rates are determined prior to leak-off using a non-linear regression model. The calibrated model is then used to generate prediction intervals for detecting leak-off and fracture pressures. Extended leak-off test interpretation is based on the system stiffness approach, in which fracture closure is associated with a reduction in system compliance. We apply change-point regression to determine the fracture closure pressure during shut-in and during flowback. The supervisory system identifies unexpected test behavior and triggers warnings by continuously evaluating key test metrics such as leakage rate, system compliance and surface pressure during each test phase.

Low-pass filtering combined with regression techniques ensure that the system is capable of analyzing field tests of variable quality and with noisy surface sensor measurements. The performance of test is assessed based on historical tests that are representative of the variation in possible pressure-volume behaviors and with typical noise levels on input sensor signals. The system of the example embodiment provides more reliable determination of leak-off and fracture pressures, fracture propagation and fracture closure pressures than manual techniques used in the prior art. The addition of real-time supervisory functionality in addition to standardization of test interpretation and analysis are immediate benefits of implementing this system. In addition, all data can be stored for future analysis and audit, as well as for use in improving and optimizing the operation of the supervisory system itself.

Various abbreviations are used herein as set out below:

| Term | Definition |
|---|---|
| APIT | Automated Pressure Integrity Tests |
| FIT | Formation Integrity Test |
| PIT | Pressure Integrity Test |
| LOT | leak off test |
| XLOT | Extended leak-off test |
| LCM | lost Circulation Material |
| MODU | Mobile Offshore Drilling Unit |
| NCS | Norwegian Continental Shelf |
| BOP | Blow out preventer |
| PLC | Programmable Logic Computer |
| PSV | Pressure Safety Valve |
| PWD | Pressure While Drilling |
| TBD | To be decided |
| TS | Technical sidetrack |
| GS | Geological sidetrack |
| P&A | Plug and abandon |
| FBP | Formation Breakdown Pressure |
| FCP | Fracture Closure Pressure |
| EMW | Equivalent Mud Weight |
| FPP | Fracture Propagation Pressure |
| FRP | Fracture Re-opening Pressure |
| ISIP | Instantaneous shut- in Pressure |
| TVD | True vertical depth |

As noted above, existing pressure integrity tests involve a manual procedure for operating the pumps and chokes as well as manual interpretation of the test results. The high dependency on manual processes also results in a low consistency and repeatability of tests. In addition to that, the industry needs a standardized and sustainable robust workflow system to meet the challenges of data logging, data storage and reporting.

The APIT system described herein makes a step-change for pressure integrity tests, leak-off tests and extended leak-off tests to enable increased use of drilling automation to allow for faster drilling with less trouble & cost. This new supervisory system provides real-time test analysis and improved automatic results interpretation of PIT, LOT and XLOT. The functionality of APIT system could perform pressure tests for qualification of formation as barrier in P & A operations and may be used in mini-frac application for openhole dual packer testing. The solutions of APIT system are reliable and orientation & structure of the GUI will be user friendly. The system automates and improves on the existing processes, and executes, interprets and stores the data the same way every time. Thus, the APIT system provides the operator with a familiar result for a familiar testing regime, but does so with improved speed, accuracy and reliability as well as providing additional capabilities not possible with the prior art, including real-time analysis, real-time quality reports, on-going warnings or 'flags' relating to problems or failures during testing, and test metrics provided automatically and in real-time.

The main steps of the existing PIT, LOT and XLOT test procedures are summarized below. A typical PIT or LOT is conducted by drilling out a few meters of new formation below the last set casing, closing the well, and pressurizing the well up to a predetermined target test pressure (for PIT) or until a deviation from a nearly linear pressure-volume curve is observed (for LOT). A representative PIT or LOT procedure is as follows:

1. Drill out casing shoe and cement and clean rat hole
2. If using lost circulation material (LCM):
   Drill approximately 1 meter new formation
   Place lost circulation material (LCM) from bottom hole and into casing/liner
   Pressurize the LCM pill and hold for 15 minutes
3. Wash to bottom and drill approximately 3 meters new formation
   Circulate clean and condition mud
4. Pull up into casing string and close BOP. Line up to pump down drill string or kill/choke line. Conduct a pressure test of the surface equipment. Check any leaking
5. Pump to reference pressure
6. Pump into well with constant rate to:
   PIT: Predetermined target test pressure
   LOT: Observed leak-off point
7. Shut-in the well and monitor pressure for at least 15 minutes
8. Bleed off to reference pressure The test is sometimes carried out with LCM that extends from the casing or liner and 1 meter down. This serves the main purpose of sealing off the formation-cement-casing interface to avoid fluid losses into permeable formations above.

An XLOT follows the same initial steps as above, but now a sizable fracture should be propagated into the formation and away from the immediate stress concentration region surrounding the wellbore. Rather than pumping to target test pressure (PIT) or leak-off (LOT), more fluid is pumped and usually two pressurization and de-pressurization cycles are performed:

6. Pump with constant rate to formation breakdown (FBP)
7. Pump an additional ~1 $m^3$ fluid to propagate the fracture into virgin formation
8. Shut-in the well for a predefined duration, typically 10-15 minutes for the first XLOT test cycle
9. Flowback to the surface over a fixed choke opening until pressure reaches reference pressure
10. Shut-in well and monitor for rebound pressure and fluid flow from fracture for 5 minutes
11. Repeat test with or without a shut-in period The cement service company is normally not directly involved in designing the formation integrity test, but they are provided with work instructions for the steps above. Work instructions are typically more detailed for XLOTs than for PIT and LOT. It is common that an XLOT procedure is reviewed by the company organization, both onshore and offshore. Cement service provider personnel will then be involved to agree on how to line up the cement unit for the upcoming test.

A person from the cement service provider will operate the cement unit during the test, while a company representative, such as a geologist, observe. The cement unit operator will act on the orders of the company representative during the tests. On newer level B cement units, the test results are logged digitally and displayed on a computer screen as the test progresses. On older level A cement units, test results are manually read by the operators and plotted by hand on a sheet of paper.

After the test is completed, a preliminary test evaluation is performed on the basis of the surface measurements from the cement unit. The best available data are to be used for the final test evaluation, which is normally performed onshore using downhole memory data from bottom-hole assembly tools. This data is usually available after tripping out of the hole. While the surface pressure measurement is influenced by the PVT behavior of the drilling fluid, casing and formation expansion as well as fluid viscoelasticity; memory data provide direct measurements of the downhole pressure at the casing shoe at high temporal resolution. Downhole data are thus clearly superior when it comes to accurate determination of minimum principal in-situ stress and other test pressures.

The proposed APIT system will follow a similar workflow to the existing tests and its functionalities will work on the basis of the surface measurements (pressure, fluid volume) from the cement unit. The surface sensors should be able to produce sufficient accuracy, as explained above, to allow for high quality test results to be produced. In some cases this may require additional or upgraded sensors. Existing installations may often not have sufficient monitoring capabilities, in particular for volume measurements.

The APIT system of the example described below uses a cement unit that can be operated remotely i.e. so called level B units or B type units. This is not essential since the A type unit can also be used, but the level B unit is the most attractive candidates for implementation on the APIT system in view of the additional synergistic advantages of having remote operation for the cement unit in conjunction with automatic monitoring of the pressure integrity tests. Consequently, the discussion in the ensuing sections will focus primarily on level B units.

There are two primary types of cement units, type A and type B, that differ mainly by how they are operated. There are currently no industry-standard definitions, but Halliburton suggests the following category definitions:

Level A: Pressure testing and pumping from a safe area using a touch screen
Level B: Remote controlled unit
Level C: Remote control from off-site location (another rig or from onshore)

Here, a level A unit represents a pressure testing facility meeting the minimum regulatory requirements for offshore drilling units. A typical level A unit on the Norwegian Continental Shelf (NCS) dates from the late 1980s or early 1990s. These units are operated mechanically, by air and by hydraulics. A level B cement unit is distinguished from level A by a remote control system, making it operable from a control room on the same installation.

A third level, a level C is used in the Statoil system to identify units that can potentially be operated from onshore. A network link to onshore is thus the only difference between a level B and a level C unit, which implies that level B units rather easily can be extended to level C functionality.

The Valhall injection platform is currently the only installation with an operable level C unit.

TABLE 1

Cement unit overview for Statoil fixed installations.

| Installation name | Cement unit level |
|---|---|
| Oseberg B | Level B |
| Oseberg Ø | Level B |
| Grane | Level B |
| Gullfaks A | Level B |
| Gullfaks B | Level B |
| Snorre A | Level B |
| Statfjord A | Old level A or level B* |
| Statfjord B | Old level A or level B* |
| Statfjord C | Old level A or level B* |
| Heidrun | Level B (new in 2016) |

*Statoil has upgraded the original level A cement units installed on the Statfjørd installations.

The two-level unit categorization (level A and level B) should be applicable for other cement unit providers and other operators as well.

The proposed APIT system takes real-time pressure and volume measurements obtained at a surface location whilst fluid is being supplied to or released from and returned from the formation. The APIT system is a computational software based system which performs real-time test analysis and automated result interpretation of FIT/LOT/XLO. This system includes a hydrostatic model, parameters estimation model, statistical approach, regression & curve fitting techniques and combines all these elements into a supervisory control system to automatically execute formation integrity tests. Based on the model assumptions and operator inputs it gives output to the existing cementing unit based on measurements and anticipated pressure build-up behavior.

The model is based on surface pump pressure measurements to measurements of injected fluid volume, and fitting the model to test observations by calibrating regression parameters corresponding to fluid compressibility, air trapped, casing and open-hole expansion and pressure-driven filtration losses to the formation.

The methods require fewer configuration data and can be based on time-resolved surface measurements of cement pump, pressure and displacement tank volume. Test interpretation and safeguarding with the APIT system can be based on these methods, which provide consistent evaluation of test results by using pre-defined confidence levels for hypothesis testing of statistical significance.

The algorithms in APIT system are relatively simple and it is anticipated that the system can be seamlessly implemented into the existing cement unit control system and data logging system. This is perceived to be a positive aspect of the system, as the implementation and use of the system will involve minor changes on the hardware side and not have substantial influence on work procedures associated with preparing the unit for pressure integrity tests.

The physical elements of the example APIT system correspond generally to a conventional level B cement unit, with some notable modifications and new minimum requirements. FIG. 1 shows an overview of an example APIT system. As is typical in the prior art displacement tanks 32 are coupled to a cement pump 12 that is arranged to provide cement to the underground formation 42 in a standard fashion. Normal monitoring and control systems 14 can be present, and they are augmented by the APIT system 26. As well as the addition of new software/monitoring elements the APIT system also necessitates the need for suitable volume and pressure measurements. A preferred minimum capability for volume measurement is real-time measurement in 10 liter steps and a preferred minimum capability for the pressure measurement is a resolution of 0.5 bar, with both pressure and volume measurements being able to be sampled at a sampling rate of 1 or 2 seconds, or less. In the example the volume measurement takes place at the displacement tanks 32 via level sensors 28. The pressure measurement can be in the flow line between the cement pump 12 and the underground formation 42 and in this case uses a pressure sensor 36. A density meter 34 is also present. The various sensors 28, 34, 36 provide readings to the level B control system 14, and this passes sensor data 16 to the APIT system 26.

An additional requirement for the cementing unit for best operation of the APIT system is that there should be a shut-in valve 22 in addition to the flowback choke valve 24 that is typically present. The APIT system 26 interacts with the existing remote and local operator stations 14 (for example a conventional level B type system) by receiving the sensor data 16 and returning, in real-time, advisory messages, warnings and safety triggers via communication channel 18. The APIT system will further provide automatic test interpretation and generate test reports including test metrics and an indication of the quality of the test data and of the interpretation thereof. In addition to the real-time monitor data for volume and pressure the APIT system is further provided with parameters including well geometry, compress ability of the fluid, temperature, casing shoe test data and water depth, and configuration data such as a setting for target pressure and a prediction or expected prognosis relating to the test result. The APIT system 26 and the local control system 14 can be coupled via a communication link 38 to an onshore operations center 40.

In the example of FIG. 1 the underground formation 42 is connected to the cement pump 12 via a stand pipe manifold at the drill floor 20 and via a choke kill line 44, with these connections being made in conventional fashion. The underground formation 42 is a wellbore with a blow-out protector 46, which is closed during the pressure integrity testing, and beneath which there are conventional casing 48 and cement 50 layers. A possible fracture 52 is indicated.

The structure and orientation of the APIT system was designed based on following functionalities:

- Hydrostatic model—this model is required for setting the system tolerance limit of APIT system.
- State detection model—it is needed for calibration and to detect different phases of FIT/LOT/XLOT followed by pressure-volume curves.
- Regression model—Statistical approach to calculate fitting parameters for state detection model.
- Contingency estimators—detection of unexpected events (trapped air. cement channel, casing expansion, casing shoe leakage, etc.).
- Control panel—for system in automation mode.
- Qualification of formation as barrier-Assessment of the minimum principal stress.

Test pressures such as leak-off pressure, formation breakdown pressure and fracture closure pressure are identified automatically by well-known statistical methods; e.g.; change point regression techniques and dynamic search for straight lines and quadratic curves.

The functionalities of APIT system have been calibrated against field test data to confirm that the APIT system works in field applications. FIGS. 2 to 15 show an example of the output of the APIT system based on real test data.

In this example the test configuration was as set out in the table below.

TABLE 2

| Wellbore data and system configuration | |
|---|---|
| Parameter | Value |
| Rig | Test Rig |
| Date of test | Oct. 10, 2010 |
| Test type | XLOT |
| Well | ABC123 |
| Wellbore | |
| RT-MSL | |
| RT-cement unit TVD | |
| Casing section [in] | 8½ |
| Casing depth TVD RT [m] | 1650.0 |
| Casing depth MD RT [m] | |
| Downhole sensor depth TVD RT [m] | |
| Well inclination [deg] | |
| Well azimuth [deg] | |
| Installation type | floater |
| Bottom hole TVD [m] | 1650.0 |
| Water depth [m] | |
| Total system volume [m3] | 171.0 |
| Pressure sensor depth [m] | 39 |
| Data type | downhole |
| Data time step duration [sec] | 2 |
| Reference pressure [bar] | 210 |
| Injection rate [l/min] | 100.0 |
| Flowback choke opening [%] | |
| Expected formation closure pressure [bar] | 35.08 |
| Volume to inject after formation breakdown [l] | 1000 |
| Drilling fluid type | WBM |
| Drilling fluid density [sg] | 1.250 |
| Casing test compliance [l/bar/100 m3] | 6.0 |
| Rig specific friction pressure gradient [bar/m] | |
| Estimated hydrostatic BHP [bar] | 197.5 |
| Use LCM | |

In this table the blank fields indicate data/parameters that could optionally be supplied and might be used by the APIT system, but were not used in the example.

The test was carried out in a generally conventional fashion for XLOT, with the addition of the automated supervisory system. The monitored pressure and volume, as recorded in real-time, are shown in FIGS. 2 to 15.

Figure 2:
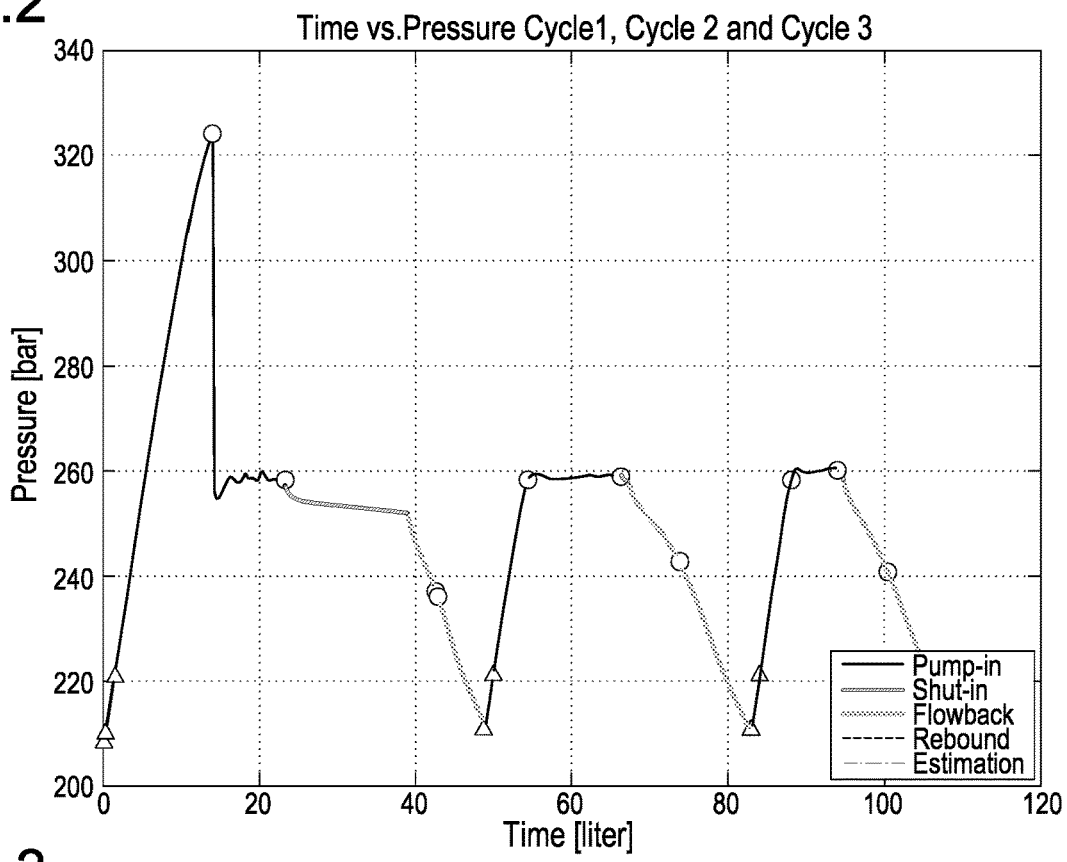
FIG. 2 is a plot of pressure against time during three cycles in an XLOT test.

FIG. 2 shows pressure against time for extended leak off test having typical characteristics. The test starts with a basic test in order to estimate the fracture pressure of the open hole section and test the integrity of the cement. Pump in continues until first the leak off pressure and then the formation breakdown pressure is reached. After the formation breakdown pressure pumping continues but the fracture volume tends to increase faster than the fluid pump in rate, which results in a distinct and rapid pressure decline stop the pressure then stabilizes at the fracture propagation pressure, which corresponds to the balance between fracture volume generation and the fluid pumping rate. Pumping is then stopped, and the pressure is equal to the instantaneous shut-in pressure.

At the end of the shut-in phase, the pressure should stabilize, indicating pressure integrity at the casing shoe and of the formation. The APIT system will issue a message in the shut-in period when the system has found a stabilized pressure. The check for whether the pressure is stable is divided into three parts:

1. Is the pressure decrease the last 10 minutes less than 2% of the downhole pressure?

If the pressure decrease the last 10 minutes is less than 2% of the downhole pressure ($p_{dh}$):

$$p(t-10)-p(t)<0.02p_{dh},$$

the message 'Pressure decrease is less than 2% of BHP during the last 10 minutes' is issued.

2. Is pressure decline rate less than the maximum limit?

We fit the measurements to $\Delta p(t)=at+b$, where t is the time since shut-in. The decline rate (a) is compared to a maximum decline rate, $a_{max}$ (bar/min):

$$a_{max} = \frac{\varphi_{max}}{V_0 C},$$

where $\varphi_{max}$ is the maximum allowable volume flux (default is 2 l/min), $V_0$ is the system volume and c is the system compliance determined from the pump-in phase. If the pressure decline rate is less than the maximum pressure decline rate ($a<a_{max}$) for 60 seconds, the message 'The volume loss rate is less than 2 l/min' is issued.

3. Is the pressure decline rate decreasing?

The pressure measurements from the last 6 minutes are divided into 3 intervals, where each interval is 2 minutes:

$$p_1=[p(t-6):p(t-4)], p_2=[p(t-4):p(t-2)]$$

and $$p_3=[p(t-2):p(t)]$$

The pressure decline rate, a, is estimated for each interval: $a_1$, $a_2$ and $a_3$, using the same regression method and formula as in 2. The pressure decline rate is decreasing if $a_3<a_2$ and $a_2<a_1$.

The pressure is defined as stable if the criteria (points 1-3) are met:

$$p(t-10)-p(t)<0.02p_{dh}$$

$$a<a_{max}$$

$$a_3<a_2 \text{ and } a_2<a_1$$

If the system defines the pressure as stable, the stable shut-in pressure, $p_{SIP}$, is set to the value of the pressure measurement 10 minutes before the pressure is declared as stable.

$$p_{SIP}=p(t-10)$$

During the first cycle a fixed shut-in period is taken before the well is flowed back. During shut-in the system pressure will gradually decrease due to fluid losses through the fracture faces depending on the duration of the shut-in period drilling fluid filtration properties and formation permeability the fracture might close during shut-in or it can remain open. In this example the fracture remains open. After shut-in, the pressure is bled off, typically through a choke valve with a fixed opening. As noted above, the fracture closure pressure is associated with an increase in system stiffness and a change in slope in a pressure and volume plot. If the flowback is through a choke with a fixed opening then a plot of pressure (or square root of pressure) as a function of time will also show a change in slope. Determining fracture closure pressure in this way is illustrated below with reference to FIGS. 10 through 15.

A second cycle is typically performed shortly after the first cycle. Pump in commences again and the pressure increases steeply. Due to compressive stresses in the rock the fracture will remain closed until the pressure reaches a fracture reopening pressure. The fracture reopening pressure should not exceed the fracture initiation pressure of the first cycle. If it does then an alert may be raised. Depending on drilling fluid type and the properties of drilling fluid the fracture reopening pressure may be slightly higher than the fracture closure pressure. Following the fracture reopening pressure the pump in continues but the pressure within the system stays generally unchanged due to continued opening of the existing fracture stop there can be a shut-in period after the pump in, and then after that the pressure is bled off in the same way as for the first cycle.

A third cycle is then carried out in a similar manner to the second cycle. It should be noted that in some cases, if the data produced by the second cycle and the first cycle is good and consistent, then the third cycle may not be necessary. One of the advantages of the proposed automated system is that the analysis of the first and second cycle can occur in real time, just as soon as the cycle has been sufficiently completed, and the system can then automatically propose whether or not a third cycle is necessary, either due to discrepancies in the original data, or to provide additional confidence for a particular scenario.

Figure 3:
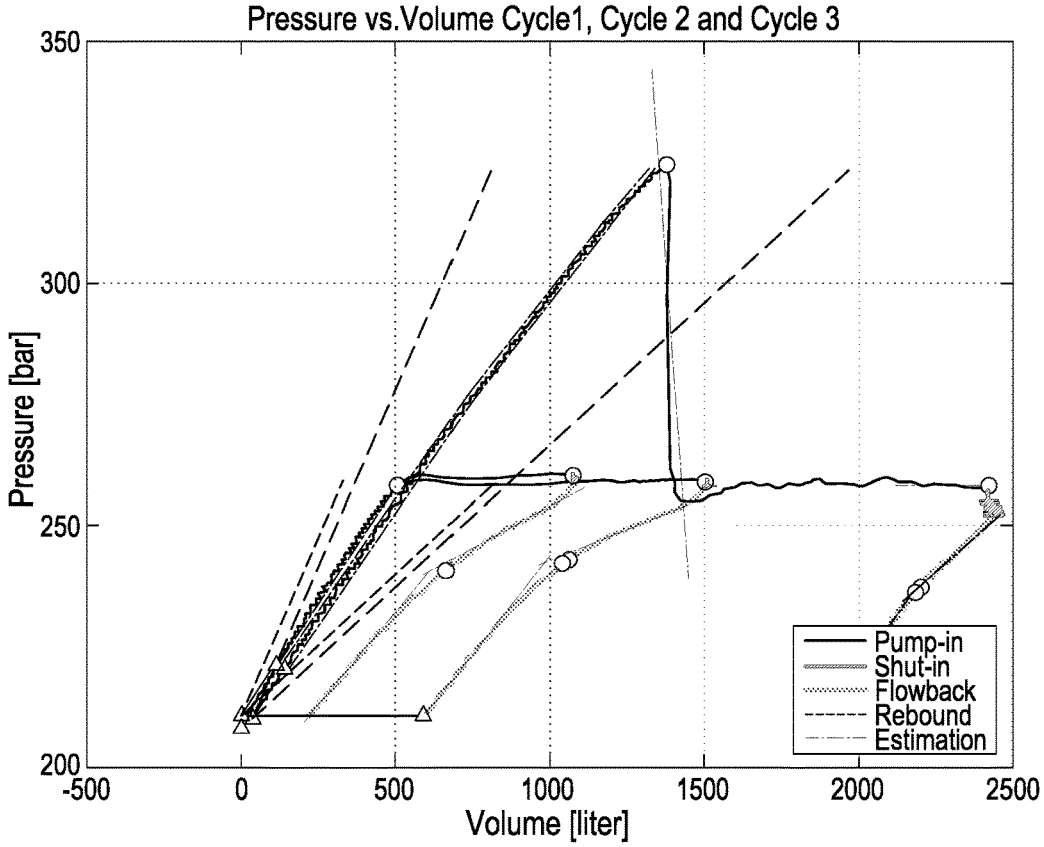
FIG. 3 shows pressure against a volume plotted for the same test.
Figure 4:
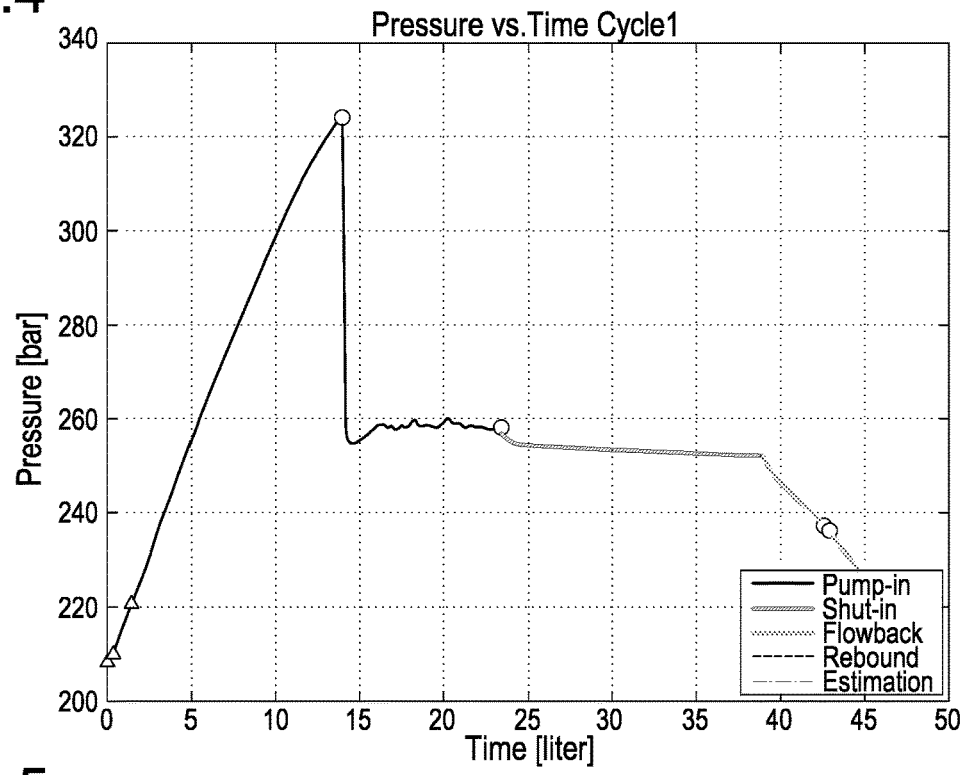
FIGS. 4 and 5 include more detail for the $1^{st}$ cycle in the test of FIG. 2.

FIG. 3 shows a plot of pressure against volume for the same three cycles as those shown in the pressure and time plot of FIG. 2. Of course, the various pressure against volume plots are overlaid, since volume is supplied and released during the three cycles. So that the various features of the three cycles can be more clearly seen, especially in relation to the plots of pressure against volume, then separate plots for each cycle are shown in FIGS. 4 through 9, again in both pressure against time and pressure against volume form. These plots, and the processing of the data relating to these plots, are discussed below with reference to the APIT system.

Figure 5:
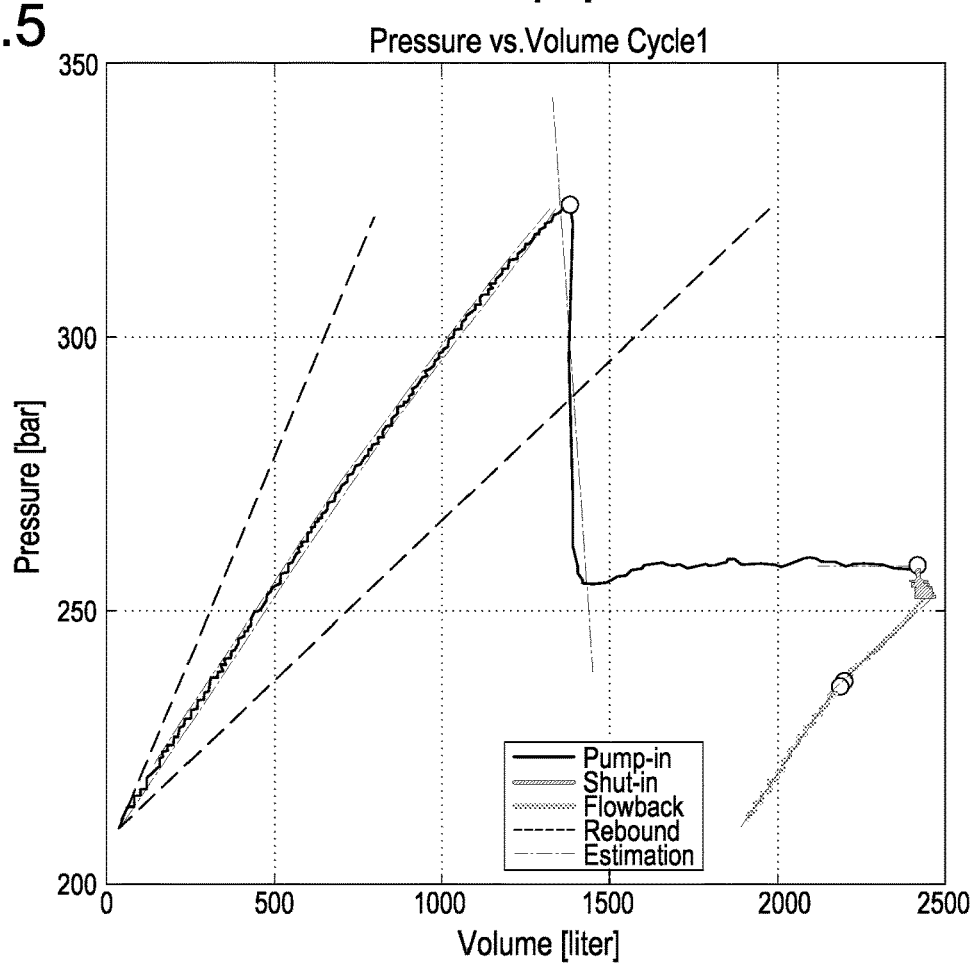
Figure 6:
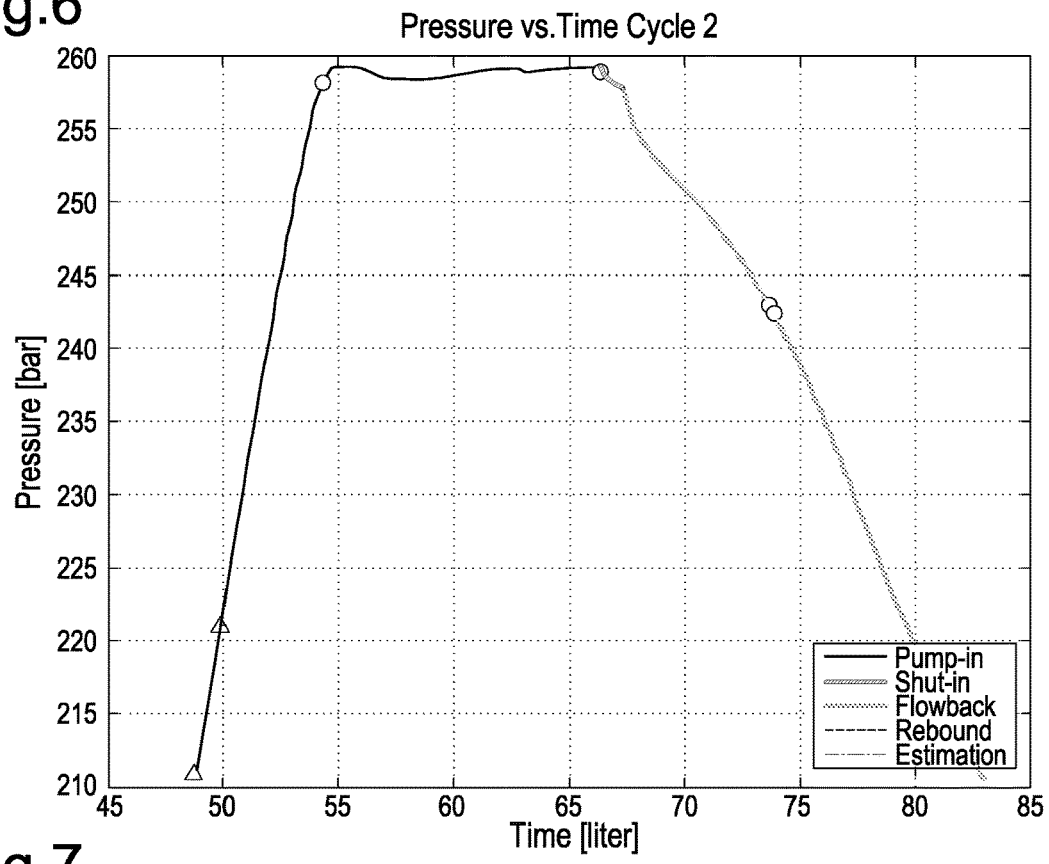
FIGS. 6 and 7 show more detail for the $2^{nd}$ cycle in the test of FIG. 2.

During pump in as the pressure and the volume increases then an envelope is set with an upper and lower threshold as shown in FIG. 5 in relation to the first cycle. A similar set of thresholds is present in FIG. 7 and FIG. 9 in relation to the second and the third cycles. The APIT system continually monitors pressure and volume as they are measured in real-time and fits a curve to recent points enabling a forecast to be made looking ahead in time. If the forecast indicates that the pressure and volume data will exceed the envelope by crossing the opera lower threshold then the test can be stopped, since this indicates a bad test. This process can be considered roughly analogous to a manual process in which the operator may watch pressure and volume values as a test progresses, and effectively guess when they might exceed the allowable envelope. However, the automated process is considerably more accurate and reliable, and can operate with a finer degree of decision-making than a manual process. This means that during the pump in phase of this type of test the automated system can ensure that whilst any test that exceeds the set limits is stopped, there is minimal risk of a false alarm and a test being stopped when in fact it could have been allowed to continue.

The automated system may also automatically take note of and record metrics such as fracture initiation pressure and fracture propagation pressure, and so on. The determination of fracture propagation pressure in particular can be more effectively done with an automated system that monitors volume as well as pressure in real-time, since by curve fitting and regression it is possible to more reliably and accurately detect the stabilization of pressure that indicates the fracture propagation pressure.

These metrics can be determined automatically during multiple cycles of a single test and compared immediately by the automated system. Hence, it is possible to check if, for example, fracture propagation pressure as indicated by the second cycle of this type of test is sufficiently similar to fracture propagation pressure as indicated by the first cycle. This can provide a way to determine whether or not a third cycle is required. If the first two tests give identical or very similar results then one might have the confidence to avoid the time and expense of a third cycle of the test.

Figure 7:
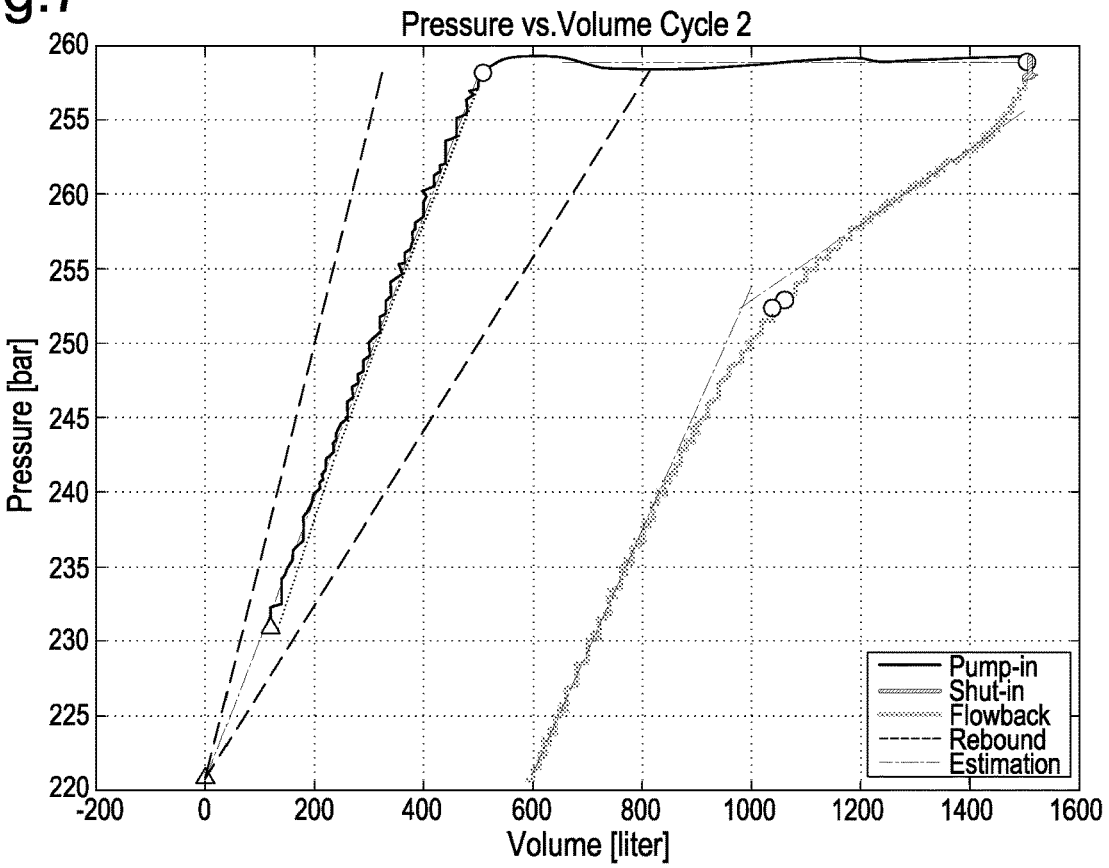
Figure 8:
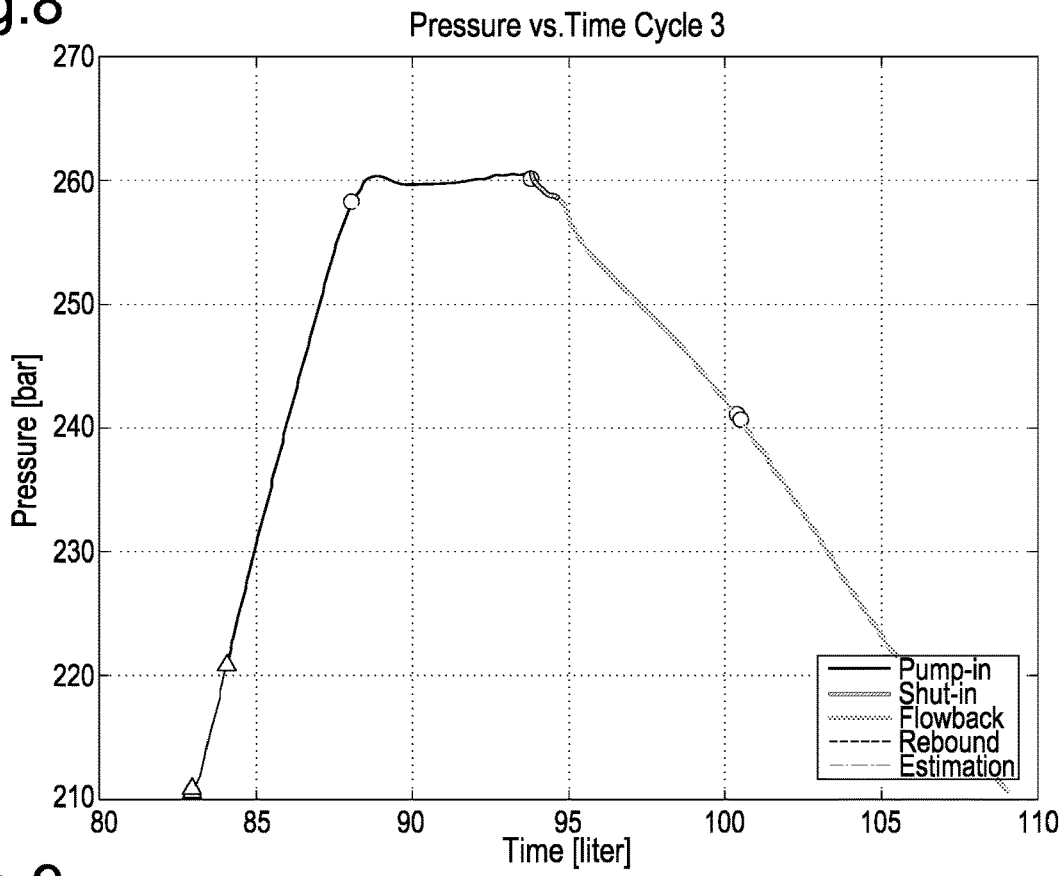
FIGS. 8 and 9 show more detail for the $3^{rd}$ cycle in the test of FIG. 2.
Figure 9:
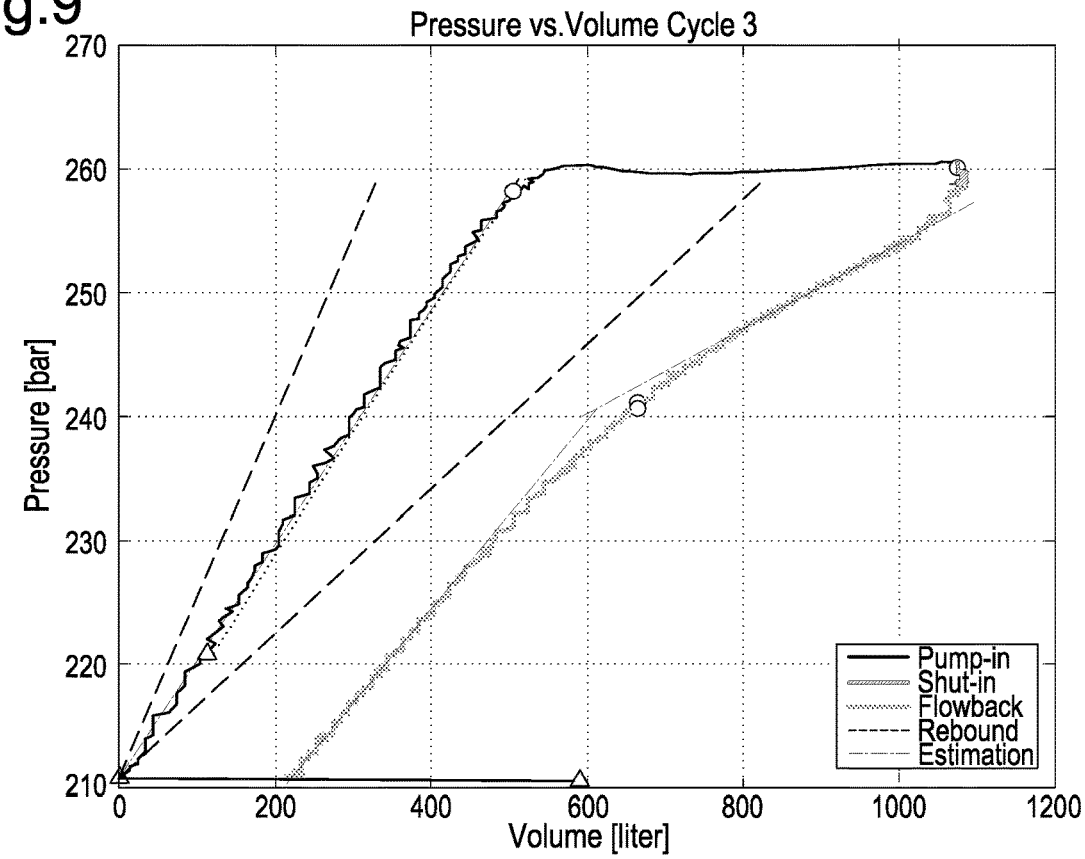

When the fluid is released and returned from the formation then a similar process of continuous real-time monitoring and analysis is carried out. During this part of the cycle the fracture closure pressure is often of most interest. The fracture closure pressure can be determined by fitting two straight lines to the curve during flowback as shown in FIGS. 5, 7 and 9, and as illustrated in greater detail in FIGS. 11, 13 and 15. A point of intersection of the two straight lines is identified, and this allows a value for the fracture closure pressure to be obtained. Once again, values between different cycles of the same test can be determined immediately and compared to check whether or not a third or subsequent cycle is required. In addition, since there is no need for analysis after testing has been completed then a report relating to the test can be produced immediately upon completion of the test by the automated system including details of the fracture closure pressure as well as a degree of confidence in the test result, which might perhaps be determined based on similarity of results between different cycles, or a comparison of topside and downhole data and so on. A further discussion of on-going and real-time assessment of the quality of the test is set out below.

Figure 10:
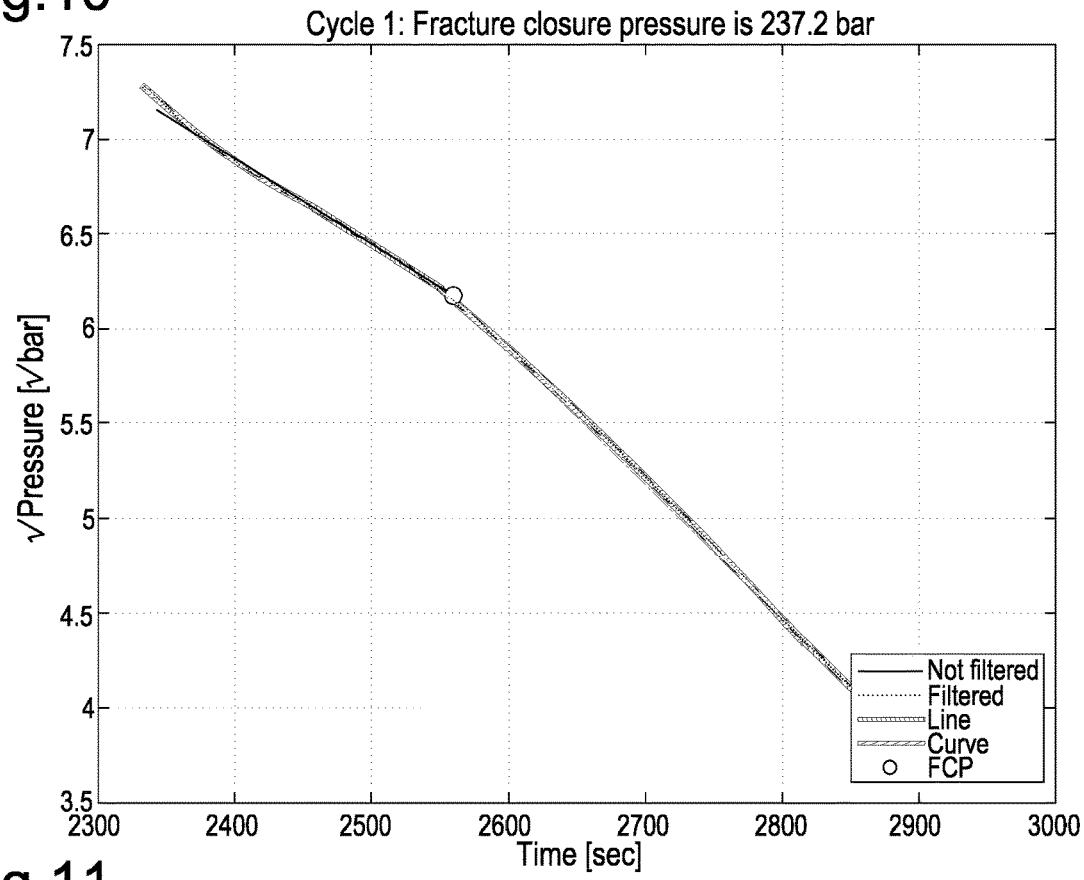
FIGS. 10 and 11 illustrate plots used for determining the fracture closure pressure during the $1^{st}$ cycle.
Figure 11:
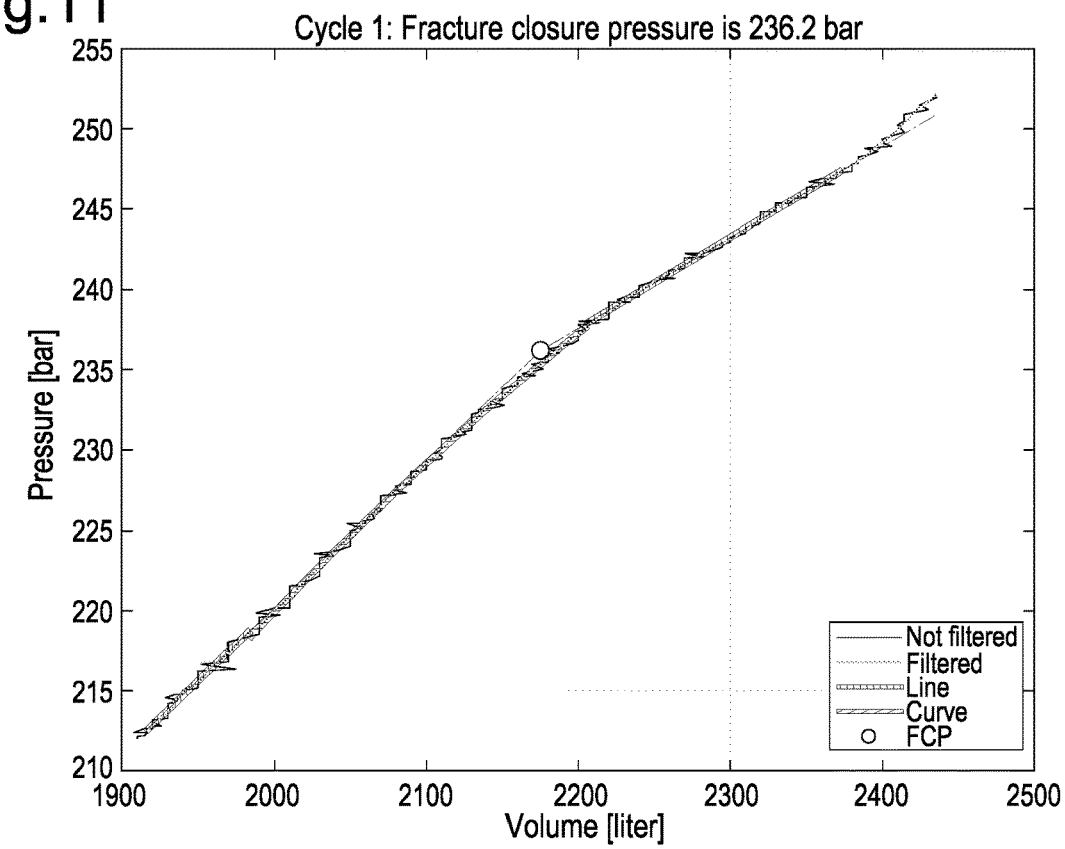
Figure 12:
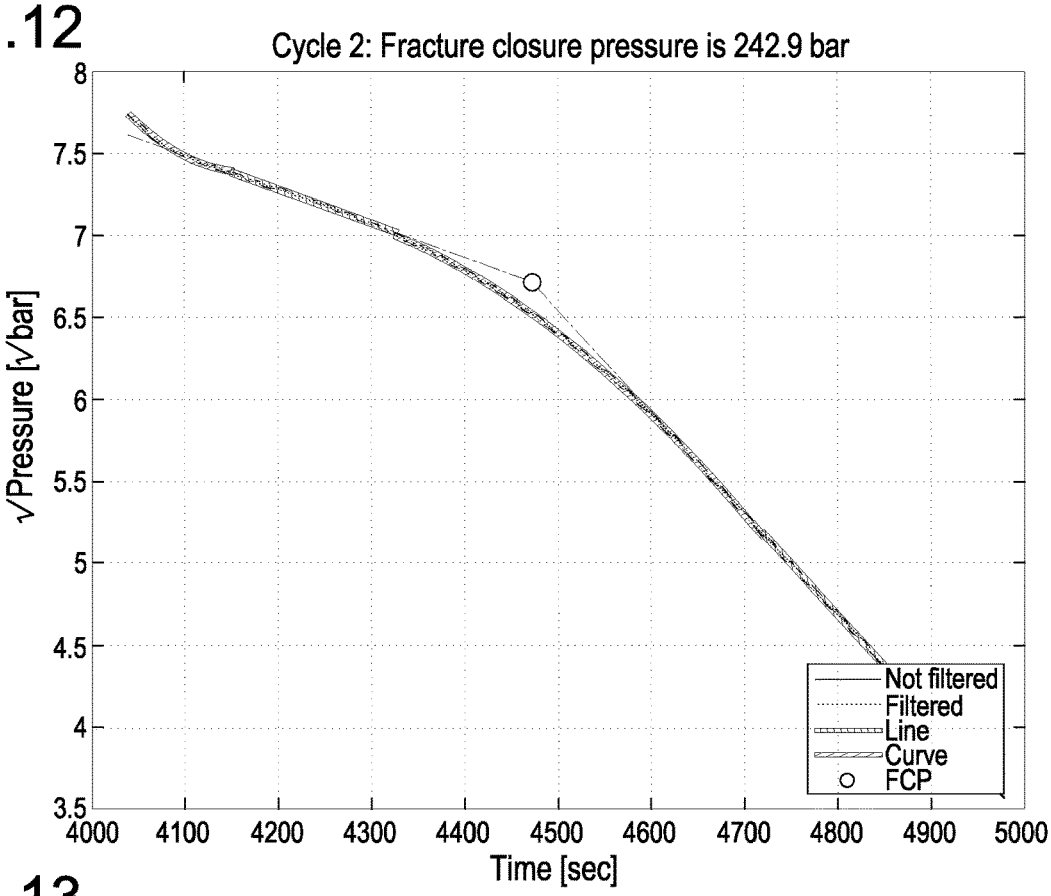
FIGS. 12 and 13 show similar plots relating to fracture closure pressure for the $2^{nd}$ cycle.
Figure 13:
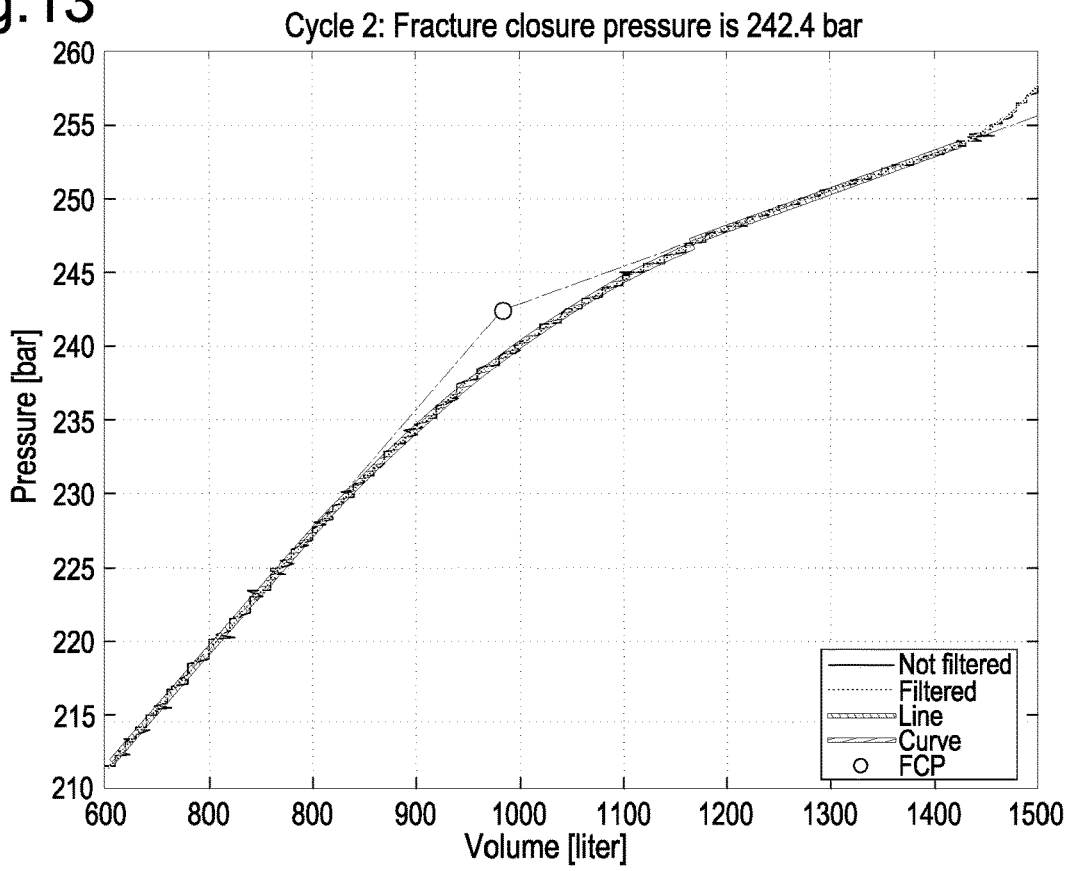
Figure 14:
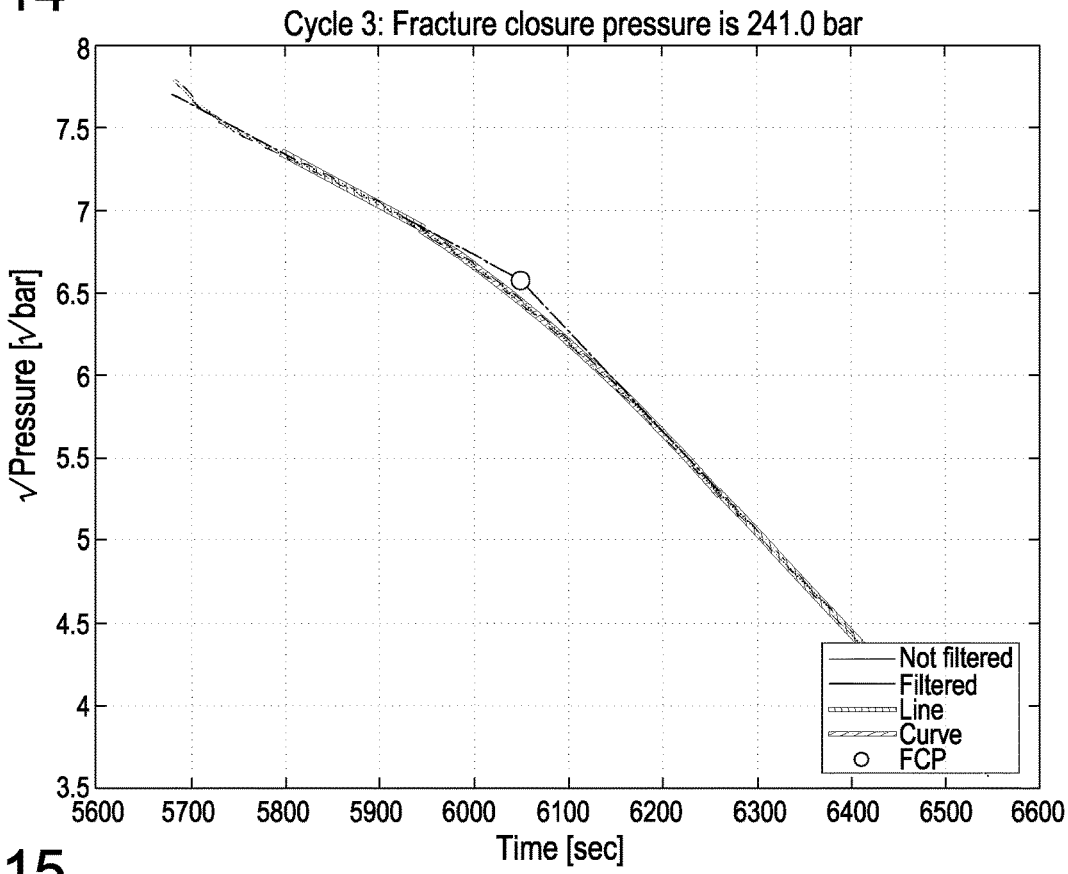
FIGS. 14 and 15 show similar plots relating to fracture closure pressure for the $3^{rd}$ cycle.
Figure 15:
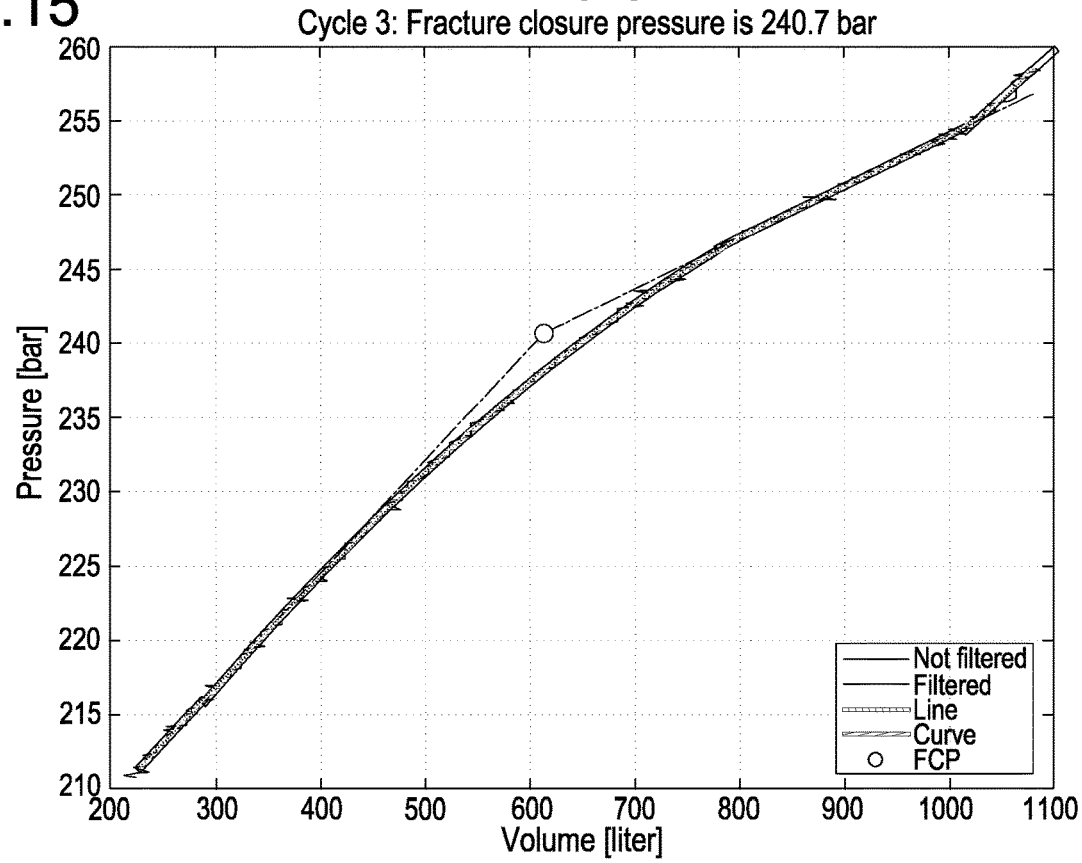

As noted above, the fracture closure pressure can also be determined based on a plot of the square root of pressure against time. Again this is done by fitting two straight lines to the plot and finding the intersection of the lines. FIGS. 10, 12 and 14 show examples of this. The automated system allows for this to be done in real time just as soon as the data is available. The fracture closure pressure determined using this technique can be compared with the fracture closure pressure determined using the plot of pressure against volume. This allows for another data point and another comparison to check the quality of the text and ensure confidence in the results. Again this can be done in real-time.

Parameters determined by the APIT system during the tests illustrated in the Figures are shown in Table 3 below.

TABLE 3

Test results

| Parameters-Test results | Cycle 1 | Cycle 2 | Cycle 3 |
|---|---|---|---|
| Estimated fluid compressibility [l/bar/100 $m^3$] | 5.8 | 6.1 | 5.7 |
| Estimated fluid leak coefficient [1/min/bar] | 0.1 | 0.0 | 0.1 |
| Measured system compliance pump-in [l/bar/100 $m^3$] | 6.7 | 6.1 | 6.1 |
| Measured system compliance flowback [l/bar/100 $m^3$] | 6.6 | 7.8 | 8.2 |
| Measured Friction pressure loss [bar] | 0.7 | 0.7 | 0.8 |
| Measured Pump-in volume [l] | 2410 | 1516 | 1080 |
| Measured Flowback volume [l] | 524 | 910 | 856 |
| Estimated Leak-off pressure [bar] | N/A | N/A | N/A |
| Estimated Fracture reopening pressure [bar] | N/A | 258.1 | 258.2 |
| Estimated Formation breakdown pressure [bar] | 324.2 | N/A | N/A |
| Estimated Fracture propagation pressure [bar] | 258.1 | 258.8 | 260.1 |
| Estimated Fracture closure pressure shut-in (sqrt(t)-p) [bar] | N/A | N/A- | N/A |
| Estimated Fracture closure pressure flowback (t-sqrt(p)) [bar] | 237.2 | 242.9 | 241.0 |
| Estimated Fracture closure pressure flowback (v-p) [bar] | 236.2 | 242.4 | 240.7 |

TABLE 3-continued

| Test results | | | |
|---|---|---|---|
| Parameters-Test results | Cycle 1 | Cycle 2 | Cycle 3 |
| Estimated Fracture closure pressure shut-in (sqrt(t)-p) [g/cm$^3$] | N/A | N/A | N/A |
| Estimated Fracture closure pressure flowback (t-sqrt(p)) [g/cm$^3$] | 1.465 | 1.501 | 1.489 |
| Estimated Fracture closure pressure flowback (v-p) [g/cm$^3$] | 1.459 | 1.498 | 1.487 |

In this table the "N/A" indicates data/parameters that could be determined by the APIT system, but were not found in this example or not applicable for the respective cycle.

As well as an analysis of the tests and on-going alerts as discussed above there are also numerous other notifications and alerts that can be made by the APIT system. For this example the table below lists all the info messages, warnings and alarms issued while running the APIT supervisory system. A triangle symbol (ˆ) is used for warnings/alerts and a circle symbol (○) is used for interpreted values; i.e. LOP, FPP, FCP, FRP etc.

TABLE 4

| APIT system outputs. | | | | | |
|---|---|---|---|---|---|
| Time [min] | Pressure [bar] | Volume [liters] | Test phase | Info/warning/alarm message | Symbol |
| 0.4 | 210.1 | 35.7 | Pump-in | Forcing analysis to start at 210.1 bar | ˆ |
| 1.5 | 220.6 | 140.0 | Pump-in | Prediction intervals established | ˆ |
| 1.5 | 220.6 | 140.0 | Pump-in | Crossed min volume line | ˆ |
| 13.5 | 322.3 | 1330.0 | Pump-in | Deviation from linear trend | |
| 14.0 | 324.2 | 1380.0 | Pump-in | Deviation from linear trend identified as formation breakdown. FBP is 324.2 bar, no leak-off point identified | ○ |
| 22.9 | 257.8 | 2390.0 | Pump-in | Injected volume has reached 1000 liters | |
| 23.4 | 258.1 | 2420.0 | Pump-in | Stable pressure last 250 liters, average FPP is 258.1 bar | ○ |
| 23.4 | 257.3 | 2420.0 | Pump-in | Going to shut-in phase | |
| 37.8 | 252.2 | 2434.3 | Shut-in | Pressure decrease is less than 2.0% of BHP during the last 10 minutes | |
| 38.5 | 252.1 | 2435.7 | Shut-in | The volume loss rate is less than 2.0 liters/min | |
| 38.5 | 252.1 | 2435.7 | Shut-in | Stable shut-in pressure is 253.8 bar | |
| 38.9 | 252.1 | 2434.3 | Shut-in | Fracture closure pressure is not identified in shut-in phase | |
| 38.9 | 252.1 | 2434.3 | Shut-in | Going to flowback phase | |
| 42.6 | 237.2 | 2200.0 | Flowback | Fracture closure pressure is 237.2 bar (time-square root of pressure analysis) | ○ |
| 42.9 | 236.2 | 2185.7 | Flowback | Fracture closure pressure is 236.2 bar (volume-pressure analysis) | ○ |
| 48.7 | 212.1 | 1910.0 | Flowback | The difference in FCP from pressure-volume and time-square root of pressure analysis is −1.1 bar | |
| 48.7 | 212.1 | 1910.0 | Flowback | The system stiffness in pump-in and flowback after closed fracture is similar (pump-in compliance: 6.7, flowback compliance: 6.6) | |
| 48.7 | 212.1 | 1910.0 | Flowback | The flowback volume is 524 liters and the pump-in volume is 2410 liters. The flowback volume is 22% of the pump-in volume | |
| 48.7 | 212.1 | 1910.0 | Flowback | Shutting in | |
| 48.8 | 210.8 | 0.0 | Flowback | Starting XLOT cycle 2 | |
| 48.8 | 210.8 | 0.0 | Flowback | Pump pressure higher than maximum allowable pressure | ˆ |
| 48.8 | 210.8 | 0.0 | Pump-in | Forcing analysis to start at 210.8 bar | ˆ |
| 49.9 | 220.9 | 120.0 | Pump-in | Prediction intervals established | ˆ |
| 50.6 | 228.4 | 180.0 | Pump-in | Crossed min volume line | ˆ |
| 54.3 | 258.1 | 510.0 | Pump-in | Deviation from linear trend identified as fracture reopening. FRP is 258.1 bar | ○ |
| 66.3 | 258.8 | 1505.7 | Pump-in | Stable pressure last 800 liters, average FPP is 258.8 bar | ○ |
| 66.3 | 259.3 | 1505.7 | Pump-in | The difference in fracture propagation pressure between cycle 1 and 2 is 0.7 bar | |
| 66.3 | 259.3 | 1505.7 | Pump-in | Going to shut-in phase | |
| 67.3 | 257.7 | 1500.0 | Shut-in | Going to flowback phase | |
| 73.7 | 242.9 | 1060.0 | Flowback | Fracture closure pressure is 242.9 bar (time-square root of pressure analysis) | ○ |
| 73.9 | 242.4 | 1040.0 | Flowback | Fracture closure pressure is 242.4 bar (volume-pressure analysis) | ○ |
| 82.9 | 210.7 | 590.0 | Flowback | The difference in FCP from pressure-volume and time-square root of pressure analysis is −0.5 bar | |

TABLE 4-continued

APIT system outputs.

| Time [min] | Pressure [bar] | Volume [liters] | Test phase | Info/warning/alarm message | Symbol |
|---|---|---|---|---|---|
| 82.9 | 210.7 | 590.0 | Flowback | The system stiffness in pump-in and flowback after closed fracture is similar (pump-in compliance: 6.1, flowback compliance: 7.8) | |
| 82.9 | 210.7 | 590.0 | Flowback | The flowback volume is 910 liters and the pump-in volume is 1516 liters. The flowback volume is 60% of the pump-in volume | |
| 82.9 | 210.7 | 590.0 | Flowback | Shutting in | |
| 83.0 | 210.8 | 4.3 | Rebound | Starting XLOT cycle 3 | |
| 83.0 | 210.8 | 4.3 | Rebound | Pump pressure higher than maximum allowable pressure | ^ |
| 83.0 | 210.8 | 4.3 | Pump-in | Forcing analysis to start at 210.8 bar | ^ |
| 84.1 | 221.4 | 120.0 | Pump-in | Prediction intervals established | ^ |
| 84.2 | 222.1 | 114.3 | Pump-in | Crossed min volume line | ^ |
| 88.0 | 258.2 | 504.3 | Pump-in | Deviation from linear trend identified as fracture reopening. FRP is 258.2 bar | ○ |
| 93.8 | 260.1 | 1074.3 | Pump-in | Stable pressure last 300 liters, average FPP is 260.1 bar | ○ |
| 93.8 | 260.6 | 1074.3 | Pump-in | The difference in fracture propagation pressure between cycle 1 and 3 is 2.0 bar | |
| 93.8 | 260.6 | 1074.3 | Pump-in | The difference in fracture propagation pressure between cycle 2 and 3 is 1.3 bar | |
| 93.8 | 260.6 | 1074.3 | Pump-in | Going to shut-in phase | |
| 94.7 | 258.6 | 1080.0 | Shut-in | Going to flowback phase | |
| 100.4 | 241.0 | 664.3 | Flowback | Fracture closure pressure is 241.0 bar (time-square root of pressure analysis) | ○ |
| 109.0 | 210.8 | 224.3 | Flowback | The difference in fracture closure pressure between cycle 1 and cycle 3 is 3.8 bar (time-square root of pressure analysis) | |
| 109.0 | 210.8 | 224.3 | Flowback | The difference in fracture closure pressure between cycle 2 and cycle 3 is 1.9 bar (time-square root of pressure analysis) | |
| 100.5 | 240.7 | 653.0 | Flowback | Fracture closure pressure is 240.7 bar (volume-pressure analysis) | ○ |
| 109.0 | 210.8 | 224.3 | Flowback | The difference in FCP from pressure-volume and time-square root of pressure analysis is −0.4 bar | |
| 109.0 | 210.8 | 224.3 | Flowback | The system stiffness in pump-in and flowback after closed fracture is similar (pump-in compliance: 6.1, flowback compliance: 8.2) | |
| 109.0 | 210.8 | 224.3 | Flowback | The flowback volume is 856 liters and the pump-in volume is 1080 liters. The flowback volume is 79% of the pump-in volume | |
| 109.0 | 210.8 | 224.3 | Flowback | Total flowback volume is 45.7% of total pump-in volume | |
| 109.0 | 210.8 | 224.3 | Flowback | Shutting in | |
| 109.0 | 210.8 | 224.3 | Flowback | The data quality is Excellent (5). | |
| 109.0 | 210.8 | 224.3 | Flowback | The Shmin quality is Average (3). Total flowback volume is less than 50% of total pump-in volume | |
| 109.0 | 210.8 | 224.3 | Flowback | The overall test quality is Good (4). Total flowback volume is less than 70% of total pump-in volume | |

It will be appreciated that the APIT system can provide a large amount of information that it is not possible to obtain using the prior art integrity tests where analysis and interpretation is done manually. This is a significant advantage of the APIT system, which is achieved by gathering both pressure and volume data in real-time and by performing an analysis as the data is gathered and in an automated fashion.

The APIT system of course also be used to automatically derive any other test metrics that may be required, and it can repeat any analysis done in the prior art either in the same way, after the test, or generally in a quicker fashion during the test, including providing results that may impact on whether or not future cycles of the test are carried out or whether the test might be stopped on grounds of bad data, for example.

The following Tables 5-10 list various messages providing information, warnings or alarms that may be issued by the proposed system. The system may thus be arranged to provide one of more of the listed messages in the specified phase, and preferably it is arranged to use all of the listed messages.

TABLE 5

| Info, warning or alarm message in the pressurization phase (pump-in) | | |
|---|---|---|
| Message | Classification | Description |
| Crossed max/min volume line | Warning | Pressure/volume curve falls outside the area spanned by the minimum line $\Delta p = (cV_0)^{-1}\Delta V = C_{min}^{-1}\Delta V$ and the maximum line $\Delta p = C_{max}^{-1}\Delta V$. $\Delta V_i = V_i - V_1$, and $\Delta p_i = p_i - p_1$ |
| Unstable pump rate | Warning | 10 subsequent volume measurements are outside the prediction interval, $[V_{min}, V_{max}]$ |
| Fluid leak coefficient above tolerance limit | Warning | Volume estimated using regression model with leak coefficient, $\Delta\hat{V}_{leak}$, is higher than 25% of the volume estimated using regression model without leak coefficient, $\Delta\hat{V}_{no\ leak}$, for 15 subsequent measurements |
| Pressure less than predicted, possible leakage | Warning | 6 subsequent volume measurements are higher than what is predicted when the pressure is lower than 30% of the target test pressure for PIT, or 30% of the expected LOP for LOT/XLOT tests. |
| Pressure less than predicted, possible leak-off. Stop test? | Warning | 6 subsequent volume measurements are higher than what is predicted when the pressure is higher than 30% of the target test pressure for PIT. |
| Deviation from linear trend identified as leak-off. LOP is X bar | Info | 6 subsequent volume measurements are higher than what is predicted when the pressure is higher than 30% of expected LOP for LOT/XLOT tests. |
| Pressure higher than predicted | Warning | 30 subsequent volume measurements are lower than the predicted volume |
| Pressure higher than maximum allowable test pressure | Alarm | Measured pressure is higher than the maximum allowable test pressure. |

TABLE 6

| Info, warning or alarm messages in the shut-in phase (PIT) | | |
|---|---|---|
| Message | Classification | Description |
| Pressure decrease is less than 2% of BHP | Info | The pressure decrease the last 10 minutes is less than 2% of the bottom hole pressure. |
| The volume loss rate is less than 2 liters/min | Info | The slope of the pressure vs. time curve is less than the upper tolerance criterion, $a_{max}$. Default value is $a_{max} = \frac{\varphi_{max}}{V_0 C}$, where $\varphi_{max}$ = 2 liters/min. |
| The volume loss rate is more than 2 liters/min | Warning | Issued if the above alarm (Table 5) is issued and the slope of the pressure vs. time curve is higher than the upper tolerance criterion, $a_{max}$ at a later time. |
| Stable shut-in pressure is X bar | Info | This message is issued if the 3 criteria for stable pressure is fulfilled: criteria for volume loss rate, criteria for pressure drop last 10 minutes, and the pressure decline rate must be decreasing |

TABLE 6-continued

| Info, warning or alarm messages in the shut-in phase (PIT) | | |
|---|---|---|
| Message | Classification | Description |
| Pre-defined shut-in time reached. Consider to extend the shut-in phase | Info | This message is issued if the pre-defined shut-in time is reached and the pressure has not stabilized. |
| Pre-defined shut-in time reached | Info | This message is issued if the pre-defined shut-in time is reached and the pressure has stabilized. |
| Shut-in complete. Pressure decrease since ISIP is X bar | Info | When the choke is opened for flowback, the pressure decrease since the initial shut-in pressure is calculated. |

TABLE 7

| Info, warning, or alarm messages in the fracture propagation phase | | |
|---|---|---|
| Message | Classification | Description |
| Pressure higher than maximum allowable test pressure | Alarm | The measured pressure is higher than the maximum allowable test pressure. |
| Injected volume has reached maximum limit | Warning | The total injected volume has reached the configured maximum volume, i.e. the tank volume |
| Injected volume has reached target volume | Info | The specified volume to inject after leak-off or formation breakdown is reached |
| Stable pressure last X liters. Average FPP is Y bar | Info | The fracture propagation pressure is estimated to the average of the pressure readings in the stable pressure region. |
| Increasing pressure last X liters, average pressure is Y bar | Info | The pressure is increasing in the fracture propagation phase |
| Decreasing pressure last X liters, average pressure is Y bar | Info | Where pressure is linearly (stably) decreasing. |

TABLE 8

| Info, warning or alarm messages in the shut-in phase (XLOT) | | |
|---|---|---|
| Message | Classification | Description |
| Pressure decrease is less than 2% of BHP | Info | The pressure decrease the last 10 minutes is less than 2% of the bottom hole pressure. |
| The volume loss rate is less than 2 liters/min | Info | The slope of the pressure vs. time curve is less than the upper tolerance criterion, $a_{max}$. Default value is $a_{max} = \frac{\varphi_{max}}{V_0 C}$, where $\varphi_{max}$ = 2 liter/min. |
| The volume loss rate is more than 2 liters/min | Warning | Issued if the above alarm (table-7) is issued and the slope of the pressure vs. time curve is higher than the upper tolerance criterion, $a_{max}$ at a later time. |
| Stable shut-in pressure is X bar | Info | This message is issued if the 3 criteria for stable pressure are fulfilled: criteria for |

TABLE 8-continued

Info, warning or alarm messages in the shut-in phase (XLOT)

| Message | Classification | Description |
|---|---|---|
| | | volume loss rate, criteria for pressure drop last 10 minutes, and the pressure decline rate must be decreasing |
| Pre-defined shut-in time reached. Consider to extend the shut-in phase | Info | This message is issued if the pre-defined shut-in time is reached and the pressure has not stabilized. |
| Pre-defined shut-in time reached | Info | This message is issued if the pre-defined shut-in time is reached and the pressure has stabilized. |
| Going to flowback | Info | This message is issued when the choke is opened for flowback |
| Fracture closure pressure candidate is X bar. Identified in shut-in phase | Info | Issued if the dynamic search for FCP in the shut-in phase detects an FCP candidate |

TABLE 9

Info, warning or alarm messages in the flowback phase (XLOT)

| Message | Classification | Description |
|---|---|---|
| Fracture closure pressure is X bar (✓pressure-time analysis) | Info | Fracture closure pressure is identified using the ✓pressure vs. time analysis |
| Fracture closure pressure is X bar (pressure-volume analysis) | Info | Fracture closure pressure is identified using the pressure vs. volume analysis |
| The compliance in pump-in and flowback after closed fracture is similar | Info | The slope of the pressure vs. volume curve in the flowback phase is less than two times the slope in the pump-in phase |
| The compliance in pump-in and flowback after closed fracture is not similar | Info | The slope of the pressure vs. volume curve in the flowback phase is higher than two times the slope in the pump-in phase |
| The flowback volume is X liters, and the pump-in volume is X liters. The flowback volume is X % of the pump-in volume | Info | At the end of the flowback period, the flowback volume is calculated and compared to the pump-in volume. |

TABLE 10

Info, warning or alarm messages in the rebound phase (XLOT)

| Message | Classification | Description |
|---|---|---|
| Pre-defined rebound time is reached | Info | The pre-defined rebound time is reached |
| Final rebound pressure is X bar | Info | The final pressure in the rebound shut-in phase is given as output |

In connection with the input data and the quality of interpretation of the data the APIT system includes further capabilities for providing an indication of the quality of the test. It does this by continually assessing parameters relating to the data in real-time. In one example of a process of this type the APIT system may provide a ranking based on the scheme set out in Table 11 below. The data quality is ranked from 1 to 5, with one being worthless and 5 being excellent. If all of the criteria are met then the data quality is deemed to be excellent

TABLE 11

Data quality test

| Criteria | Quality ranking if criteria not met |
|---|---|
| Is the data usable for interpretation? | 1. Fail/Worthless |
| Is the sampling rate topside downhole less than 5 seconds? | 2. Poor |
| Is there downhole data? | 3. Average |
| Is both topside and downhole data available? | 3. Average |
| Are both topside and downhole sampling rates below 5 seconds? | 3. Average |
| Is volumetric flowback data available? | 3. Average |
| Is the topside data sampling rate below 1 second? | 4. Good |
| Is the downhole sampling rate below 2 seconds? | 4. Good |
| Is a volumetric flowback data sampling rate below 2 seconds? | 4. Good |

Other factors may also be considered along with those tabulated above. By way of example, factors that might result in a ranking of 1 (i.e. worthless/fail) may include non-linear pump in compliance and/or fracture closure pressure values determined based on top side measurements having greater than 0.1 SG between maximum and minimum values. If those requirements are passed then factors that might result in a ranking of 2 could include the pump in compliance being excessively high, for example more than twice the expected value and/or fracture closure pressure values determined based on downhole measurements having greater than 0.1 SG between maximum and minimum values. If those requirements are passed then factors that might result in a ranking of 3 could include pump in compliance being more than 1.5 times the expected value, a failure to have a minimum number of pump in cycles (for example at least two pump in cycles), fracture closure pressure values having greater than 0.05 SG difference, total flowback volume being less than 50% and/or the closed fracture compliance being in excess of twice the expected fracture compliance. If those requirements are passed then factors that might result in a ranking of 4 could include pump in compliance being more than 1.25 times the expected value, closed fracture compliance being more than 1.75 times the expected value, total flowback volume being less than 70%, and a failure for all fracture closure pressure interpretations to be within 0.02 SG. If all these factors are passed then the quality would be ranked as excellent.

It will be appreciated that alternative quality test criteria could be set, and the ranking system could of course be adjusted to suit individual operators and particular requirements. A significant advantage arises with the APIT system since it can provide a quality ranking both during conducting a test and also immediately when a test is completed. The operator may set a minimum ranking for a test to be allowed to continue, so that if any criteria is failed indicating, for example, a ranking of 3 or below and the test is stopped and repeated with improvements made to increase the quality of the test. The operator may allow tests to continue despite a low ranking, but then assign less importance or lesser certainty to the results of those tests, and perhaps allocate resources to repeating those tests of the lowest quality from a given sequence or series of testing.

Various benefits of introducing the proposed new system for supervisory and automation functionalities for the formations integrity tests (e.g. PIT, LOT, XLOT) are as follows:

- the system analyses test data using statistical methods that provide clear and quantitative information regarding observed and predicted behavior. This can be of great value for the users of the system, since identification of test pressures such as leak-off and fracture closure pressures will now be based on statistical data analyses rather than subjective evaluations.
- The system will improve the consistency of the test by providing users with online result analysis and safeguarding functionalities and repeatability of test.
- Supervisory and automatic safeguarding functionalities can have a positive impact on safety and provide early-detection of unexpected system behavior, such as non-linear pressure behavior during pump-in (e.g. caused by large permeability losses to formation or through channels in the cement), or unexpected change in system stiffnesses between two subsequent XLOT cycles.
- The system stores test result with system configuration parameters in a predefined data format. Standardization of test reporting will facilitate our understanding of hydraulic fracturing, fracture propagation and fracture closure processes since result databases lend themselves to data mining methods, and systematic parameter studies.

The proposed APIT system hence provides real-time supervisory functionality during a pressure integrity tests, and can extended to automatically control the cement pump and flowback choke when run in automation mode. The system configuration should not require expert knowledge, nor should the system require significant changes to operational procedures or hardware modifications. Test report generation can be handled in conjunction with the existing logging system.

Primary purposes of conducting formation integrity tests while drilling include verification of fracture pressure in the new formation, verification of the cement integrity at the casing shoe, and, in the case of XLOTs, also measuring the magnitude of the minimum principal stress at the test depth. Test results and their interpretation can have a large impact on the drilling operation, such as motivating remedial cementing operations or adjusting the mass density of the drilling fluid in order to reduce risk of fracturing the formation. XLOT stress measurements are important both for verifying fracture and collapse pressure limits, but also when it comes to planning to permanently abandon a well. In such a case, well barriers must be placed so that the potential internal pressure is lower than the fracture pressure or the minimum principal stress of the formation.

The APIT system can represent a step-change in terms of standardizing the formation integrity test execution and interpretation. The system will generate valuable test metrics for the operator during the test, as well as clear indications concerning unexpected test behavior. This will provide important decision-support for the operator during the test, improve the overall quality of formation integrity tests and reduce the number of required test repetitions due to poor quality results and also reduce the total time of test execution at the installation. The APIT system will automatically process the test data, identify characteristic test pressures, as well as provide test quality indicators. It is therefore also expected that the system will improve the quality of the initial test interpretation, and reduce the time required for test interpretation.

As part of the pump-in analysis, the system evaluates fluid compressibility, casing expansion and potential permeability losses, where losses may be to the formation or through the cement at the casing shoe. This information is displayed during the test and may be saved to the test report generated by the system. This can be of value e.g. in determining whether to perform remedial cement operations or not. These aspects of the system can increase the overall test efficiency and reduce the non-drilling time in the operation.

The APIT system may also have positive risk-reducing effects for the formation integrity test operation and for the subsequent wellbore section drilling operation. The system can be developed with a number of safeguards that would aid the operator in unexpected behavior detection, such as sudden and uncontrolled influx into the well during shut-in or unexpected reduction in system compliance during pump-in. Early detection of unexpected behavior can thus reduce the risk associated with the test, and make it easier to treat undesired situations. The system should improve quality and reliability of the formation integrity test, as well as facilitating standardization of test execution. The resulting improved reliability and accuracy can therefore also reduce the risk for serious well control incidents during drilling of the next wellbore section, especially risks associated with unintentionally fracturing the well (and thereby experiencing lost circulation incidents that could lead to kicks) or hole collapse (that may lead to mechanically stuck pipe situations or tight hole). Such well control incidents may have significant consequences for personnel, the environment and assets.

Digitization and standardization of formation integrity test results can be useful for strengthening our understanding of hydraulic fracturing/qualification of formation as barrier/mini-frac for openhole dual packer test and be valuable for developing test interpretation techniques when e.g. XLOTs are conducted in complex stress regimes and in formations with natural and conductive fractures.

Specific advantages from the APIT system will include:

- Fewer failed tests→spend less time on field tests through better execution (statistics based on field data)
- Improved efficiency in test execution→todays time spread, expected time spared where automation offer typically 1 sigma variance less dependent on operator competence→test will be executed on less time, as the operator learning curve is not necessary
- Better data quality→less time spent on interpretation simplified drillers/operational geology/rock mechanics tasks→speed requires simplicity
- Fewer drilling process errors
- A more systematic (automated) and hence repeatable process, with readily comparable results in different installations due to the use of a common automated system.
- less manual work→more systematic and automated workflow
- less dependence on operator competence→not dependent on learning curve, advisory teaching tool
- safer and more accessible data storage
- Better precision of the process control
- less formation damage during testing due to improved process precision→reduces probability for subsequent drilling errors, like loss (investigate number of losses after FIT, compared to average population), Reduced wellbore integrity problems
early detection of unexpected behavior during testing
Fewer planning errors due to improved test data quality
Consistent testing, data collection and data reporting→better basis for data interpretation preparing for future electronic workflow
Better data quality, better interpretation with less errors→more accurately defined drilling window and improve drilling plan, reduce risk well control incidents during drilling of next section
developing improved test interpretation techniques in complex stress-regimes
simplified drillers/operational geology/rock mechanics tasks and improved reliability of testing
automatic safeguarding against unwanted/uncontrolled loss will help avoid unwanted incidents and human operational error resulting well control incidents and unwanted formation damage
reduced risk of unwanted losses to formation will result in less contamination of drilling fluid and produced reservoir fluid when starting production, leading to reduced dumped fluids Thus, the APIT system consists of a simpler hydraulic model that is evaluated by regression methods, as well as statistical and curve fitting techniques for the different test phases. These elements are integrated into a supervisory control system. The system provides real-time execution and automatic visualization and quantitative interpretation of FITs, LOTs, and XLOTs.

The real-time APIT system has proven to be reliable and ensures complete automation of the pressure testing sequence through execution, interpretation and data storage consistently. This advanced system can be adapted into a stand-alone tool for assisting a cement control system operator or it can be integrated into other technology through a drilling control system.

The results obtained from the APIT system have proven to be reliable, consistent and easily accessible as it adopts a user friendly GUI system. The calibrated pressure integrity tests results attained through the APIT system are easily downloadable, standardized and assimilated into official databases in a time efficient manner. The benefits for Operators implementing this technology are linked to:

Time and cost savings
Accurate and reliable test results without unnecessary repetitions of tests
Improved drilling operational efficiency
Reduction in formation damage
Integrated component towards drilling automation strategy Automated FIT/LOT/XLOT testing is a much safer and efficient pressure testing alternative to the current manual counterpart, which improves overall drilling performance.

The invention claimed is:

1. A method of conducting a pressure integrity test for an underground formation whilst fluid is supplied to and/or released and returned from the underground formation under pressure, the method comprising:

using an automated monitoring and supervisory system to monitor the pressure of the fluid that is being supplied to and/or returned from the underground formation in real-time;

using the automated monitoring and supervisory system to monitor a volume of the fluid that is being supplied to and/or returned from the underground formation in real-time, using the automated monitoring and supervisory system to determine one or more relationship(s) for the monitored pressure and for the monitored volume in real-time as the pressure and the volume vary relative to each other and/or with time during the real-time monitoring thereof; and using the automated monitoring and supervisory system to analyze the monitored pressure and volume data using the one or more relationship(s) in real-time in order to provide information and/or warnings in real-time, wherein the information and/or warnings concern one or more of: parameters relating to the underground formation, performance of the pressure integrity test during testing, an outcome of the pressure integrity test, quality of the monitored pressure and volume data, or test metrics, wherein the method is used during supplying of the fluid to the underground formation and the step of analyzing involves a real-time step of, during the pressure integrity test and whilst the fluid is being supplied to the underground formation, calculating a forecast that predicts future values of the pressure and the volume for a look-ahead time period and determining if the future values will cross outside of an envelope defining allowable pressure and volume values.

2. The method of claim 1 wherein a pressure sensor is located top-side at a point where the pressure is equivalent to, or has a known relationship to, the pressure at a point of entry of the fluid into the underground formation.

3. The method of claim 2, wherein the pressure sensor has a resolution of 0.5 MPa or lower.

4. The method of claim 3, wherein the pressure sensor has a pressure rating or 5000 psi or lower, and is isolatable or removable to allow for high pressure use of the automated monitoring and supervisory system during normal use, and measurement of pressure with the pressure sensor if the pressure integrity test is a lower pressure integrity test.

5. The method of claim 1, wherein a pressure sensor and a volume sensor are able to operate at a sampling rate of 5 seconds or less.

6. The method of claim 1, wherein the method is used after the fluid has been supplied to the underground formation under pressure and whilst the fluid pressure is being released and the fluid is returned from the underground formation, with the pressure and the volume of the returned fluid being monitored in real-time, and the step of analyzing involving determining a fracture closure pressure based on the monitored pressure and the monitored volume.

7. The method of claim 6, wherein the monitored pressure and volume data are used to find a system stiffness for a reaction of the underground formation to the pressure integrity test, and to identify a point when a change in stiffness indicates opening or closing of a fracture.

8. The method of claim 7, wherein the fracture closure pressure is determined by analysis of a plot of pressure against volume as the fluid is supplied to the underground formation.

9. The method of claim 7, wherein the fracture closure pressure is determined by analysis of a plot of a square root of pressure against time as the fluid is supplied to the underground formation.

10. The method of claim 7, wherein both of a plot of pressure against volume and a plot of a square root of pressure against time are used to find values for the fracture closure pressure, and the fracture closure pressure values are compared.

11. The method of claim 7, wherein multiple cycles of supplying and releasing fluid to/from the underground formation are carried out, with values for the fracture closure pressure being determined from two or more of the multiple cycles, and the fracture closure pressure values for different cycles being compared.

12. The method of claim 1, wherein the method is used after the fluid has been supplied to the underground formation under pressure and whilst the fluid pressure is being released and the fluid is returned from the underground formation, the pressure and volume of the returned fluid is monitored in real-time, and the step of analyzing involves determining expected pressure and volume values based on a hydrostatic approximation of the pressure inside the underground formation and comparing the real-time monitored pressure and volume data to the expected pressure and volume values.

13. The method of claim 1, wherein the step of analyzing involves a real-time step of, during the pressure integrity test and whilst the fluid is being supplied to the underground formation, gathering information relating to quality of data available for monitoring the pressure and/or the volume, assessing the information relating to the quality of the data including determining potential quality of interpretation of the data, and providing an indication of quality of results of the pressure integrity test results based on the information relating to the quality of the data.

14. The method of claim 13, wherein the information relating to the quality of the data may include one or more factors of sampling intervals, availability of volumetric flowback data, availability of downhole data in addition to topside data, whether the data is digital or analog, linearity of pump-in compliance, magnitude of the pump-in compliance, number of pump-in cycles, and/or fracture closure pressures determined using different methods and/or in different test cycles, wherein the indication of the quality of the results of the pressure integrity test is a ranking based on the one or more factors.

15. The method of claim 14, wherein factors that might result in a first, lowest ranking include one or more of: unusable data, non-linear pump-in compliance and/or fracture closure pressure values determined based on top side measurements having greater than 0.1 SG between maximum and minimum values.

16. The method of claim 15, wherein a second ranking higher than the first ranking is assigned if none of the factors for the first, lowest ranking are present but the information relating to the quality of the data indicates one or more of: a sampling rate for topside data being too high, the pump-in compliance being excessively high, and/or fracture closure pressure values determined based on downhole measurements having greater than 0.1 SG between maximum and minimum values.

17. The method of claim 16, wherein a third ranking higher than the second ranking is assigned if none of the factors required for the second ranking are present but the information relating to the quality of the data indicates one or more of: an absence of downhole data, a sampling rate for downhole data being too high, an absence of volumetric flow-back data, pump-in compliance being more than 1.5 times the expected value, a failure to have a minimum number of pump in cycles, fracture closure pressure values having greater than 0.05 SG difference, total flowback volume being less than 50% and/or closed fracture compliance being in excess of twice the expected fracture compliance.

18. The method of claim 17, wherein a fourth ranking higher than the third ranking is assigned if none of the factors required for the third ranking are present but the information relating to the quality of the data indicates one or more of: topside data sampling rate exceeding 1 second, downhole sampling rate exceeding 2 seconds, volumetric flowback sampling rate being above two seconds, pump-in compliance being more than 1.25 times the expected value, closed fracture compliance being more than 1.75 times the expected value, total flowback volume being less than 70%, and/or a failure for all fracture closure pressure interpretations to be within 0.02 SG.

19. The method of claim 18, wherein a fifth ranking higher than the fourth ranking is assigned if none of the factors required for the first, lowest ranking to the fourth ranking are present.

20. A computer program product comprising instructions that, when executed, cause a data processing apparatus to operate an automated monitoring and supervisory system whilst fluid is supplied to and/or released and returned from an underground formation under pressure, the automated monitoring and supervisory system being operated in accordance with the method of claim 1.

21. An automated monitoring and supervisory system for conducting a pressure integrity test for an underground formation, the automated monitoring and supervisory system being configured to operate in accordance with the method of claim 1.

22. The method of claim 1, wherein the test metrics include at least one of leakage rate, trapped air, unstable pump rate, plugged choke, system compliance, or surface pressure and surface volume.

23. A method of conducting a pressure integrity test for an underground formation whilst fluid is supplied to and/or released and returned from the underground formation under pressure, the method comprising:

using an automated monitoring and supervisory system to monitor the pressure of the fluid that is being supplied to and/or returned from the underground formation in real-time;

using the automated monitoring and supervisory system to monitor a volume of the fluid that is being supplied to and/or returned from the underground formation in real-time with a volume sensor capable of measuring the volume of the fluid in steps of 10 liters or less and with a sampling rate of 5 seconds or below;

using the automated monitoring and supervisory system to determine one or more relationship(s) for the monitored pressure and for the monitored volume as the pressure and the volume vary relative to each other and/or with time during the real-time monitoring thereof; and using the automated monitoring and supervisory system to analyze the monitored pressure and volume data using the one or more relationship(s) either in real-time or after completion of the pressure integrity test in order to provide information and/or warnings concerning one or more of: parameters relating to the underground formation, the performance of the pressure integrity test during testing, an outcome of the pressure integrity test, quality of the monitored pressure and volume data, or test metrics.

24. The method of claim 23, wherein the volume sensor allows for measurements in steps of 5 liters or less.

25. The method of claim 23, wherein the method is used during supplying of the fluid to the underground formation and the step of analyzing involves a real-time step of, during the pressure integrity test and whilst the fluid is being supplied to the underground formation, calculating a forecast that predicts future values of the pressure and the volume for a look-ahead time period and determining if the future values will cross outside of an envelope defining allowable pressure and volume values.

26. The method of claim 25, wherein the step of calculating the forecast uses at least one relationship determined in connection with the monitored pressure and volume data, and the at least one relationship is determined based on a set sample size for recent sampling points.

27. The method of claim 23, wherein the test metrics include at least one of leakage rate, trapped air, unstable pump rate, plugged choke, system compliance, or surface pressure and surface volume.

* * * * *